US008674791B2

(12) United States Patent
Fukunaga

(10) Patent No.: US 8,674,791 B2
(45) Date of Patent: Mar. 18, 2014

(54) SIGNAL TRANSMISSION DEVICE, FILTER, AND INTER-SUBSTRATE COMMUNICATION DEVICE

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 406 days.

(21) Appl. No.: 13/233,323

(22) Filed: Sep. 15, 2011

(65) Prior Publication Data

US 2012/0235773 A1 Sep. 20, 2012

(30) Foreign Application Priority Data

Sep. 21, 2010 (JP) ..... 2010-211148

(51) Int. Cl.
*H01P 3/08* (2006.01)
*H01P 7/08* (2006.01)

(52) U.S. Cl.
USPC ..... 333/204; 333/185; 333/219

(58) Field of Classification Search
USPC ..... 333/185, 202, 204, 219
See application file for complete search history.

(56) References Cited

FOREIGN PATENT DOCUMENTS

| | | |
|---|---|---|
| JP | A-2001-523412 | 11/2001 |
| JP | A-2002-185206 | 6/2002 |
| JP | A-2008-67012 | 3/2008 |
| JP | A-2008-271606 | 11/2008 |
| JP | A-2010-206319 | 9/2010 |
| JP | A-2010-206320 | 9/2010 |
| WO | WO 98/48473 | 10/1998 |

*Primary Examiner* — Robert Pascal
*Assistant Examiner* — Kimberly Glenn
(74) *Attorney, Agent, or Firm* — Oliff PLC

(57) ABSTRACT

A signal transmission device includes: a first substrate and a second substrate; a first resonance section including a first resonator and a second resonator electromagnetically coupled to each other; a second resonance section disposed side-by-side relative to the first resonance section, and electromagnetically coupled to the first resonance section to perform a signal transmission between the first and second resonance sections; and a first shielding electrode disposed between the first resonator and the second substrate and partially covering the first resonator to allow at least an open end of the first resonator to be covered therewith, and a second shielding electrode disposed between the second resonator and the first substrate and partially covering the second resonator to allow at least an open end of the second resonator to be covered therewith.

11 Claims, 26 Drawing Sheets
(1 of 26 Drawing Sheet(s) Filed in Color)

SUBSTRATE SIZE:2mm SQUARE
RELATIVE DIELECTRIC CONSTANT OF SUBSTRATE:3.85
SIZE OF ELECTRODE(1/4 WAVELENGTH RESONATOR)
1.5mm(LENGTH) × 0.2mm(WIDTH)

SIGNAL TRANSMISSION DEVICE, FILTER, AND INTER-SUBSTRATE COMMUNICATION DEVICE

BACKGROUND

This disclosure relates to a signal transmission device, a filter, and an inter-substrate communication device, each performing a signal transmission by using a plurality of substrates each of which is formed with a resonator.

A signal transmission device has been known in which a plurality of substrates, each of which is formed with a resonator, are used to perform a signal transmission. For example, Japanese Unexamined Patent Application Publication No. 2008-67012 discloses a high-frequency signal transmission device in which a resonator is structured in each of substrates which are different from each other. Those resonators are electromagnetically coupled to each other to configure two stages of filters, so as to allow a signal transmission to be established.

SUMMARY

The inventor/the inventors has/have found that when a configuration is employed where resonators, formed respectively on substrates which are different from each other, are electromagnetically coupled as described above, an electric field and a magnetic field are generated between the respective substrates. The currently-available configuration has drawbacks, in that a variation in thickness of a layer of air present between the substrates causes a large change in factors such as a coupling coefficient and a resonance frequency between the resonators, and thus factors such as a center frequency and a bandwidth configuring a filter are varied significantly.

It is desirable to provide a signal transmission device, a filter, and an inter-substrate communication device, capable of suppressing a variation in factors such as a pass frequency and a pass band caused by a variation in a distance between substrates, and thereby performing a stable operation.

A signal transmission device according to an embodiment of the technology includes: a first substrate and a second substrate which are disposed to oppose each other with a spacing in between; a first resonance section including a first resonator and a second resonator which are electromagnetically coupled to each other, the first resonator being provided in a first region of the first substrate and having an open end, and the second resonator being provided in a region of the second substrate corresponding to the first region and having an open end; a second resonance section disposed side-by-side relative to the first resonance section, and electromagnetically coupled to the first resonance section to perform a signal transmission between the first and second resonance sections; and a first shielding electrode and a second shielding electrode, the first shielding electrode being disposed between the first resonator and the second substrate and partially covering the first resonator to allow at least the open end of the first resonator to be covered therewith, and the second shielding electrode being disposed between the second resonator and the first substrate and partially covering the second resonator to allow at least the open end of the second resonator to be covered therewith.

A filter according to an embodiment of the technology includes: a first substrate and a second substrate which are disposed to oppose each other with a spacing in between; a first resonance section including a first resonator and a second resonator which are electromagnetically coupled to each other, the first resonator being provided in a first region of the first substrate and having an open end, and the second resonator being provided in a region of the second substrate corresponding to the first region and having an open end; a second resonance section disposed side-by-side relative to the first resonance section, and electromagnetically coupled to the first resonance section to perform a signal transmission between the first and second resonance sections; and a first shielding electrode and a second shielding electrode, the first shielding electrode being disposed between the first resonator and the second substrate and partially covering the first resonator to allow at least the open end of the first resonator to be covered therewith, and the second shielding electrode being disposed between the second resonator and the first substrate and partially covering the second resonator to allow at least the open end of the second resonator to be covered therewith.

Advantageously, in each of the signal transmission device and the filter, the second resonance section includes a third resonator and a fourth resonator which are electromagnetically coupled to each other, in which the third resonator is provided in a second region of the first substrate and having an open end, and the fourth resonator is provided in a region of the second substrate corresponding to the second region and having an open end, and the signal transmission device further includes a third shielding electrode and a fourth shielding electrode, in which the third shielding electrode is provided between the third resonator and the second substrate and partially covering the third resonator to allow at least the open end of the third resonator to be covered therewith, and the fourth shielding electrode is provided between the fourth resonator and the first substrate and partially covering the fourth resonator to allow at least the open end of the fourth resonator to be covered therewith. Advantageously, the second resonance section is formed by the electromagnetic coupling of the third resonator and the fourth resonator.

An inter-substrate communication device according to an embodiment of the technology includes: a first substrate and a second substrate which are disposed to oppose each other with a spacing in between; a first resonance section including a first resonator and a second resonator which are electromagnetically coupled to each other, the first resonator being provided in a first region of the first substrate and having an open end, and the second resonator being provided in a region of the second substrate corresponding to the first region and having an open end; a second resonance section disposed side-by-side relative to the first resonance section, and electromagnetically coupled to the first resonance section to perform a signal transmission between the first and second resonance sections, the second resonance section including a third resonator and a fourth resonator which are electromagnetically coupled to each other, the third resonator being provided in a second region of the first substrate and having an open end, and the fourth resonator being provided in a region of the second substrate corresponding to the second region and having an open end; a first shielding electrode and a second shielding electrode, the first shielding electrode being disposed between the first resonator and the second substrate and partially covering the first resonator to allow at least the open end of the first resonator to be covered therewith, and the second shielding electrode being disposed between the second resonator and the first substrate and partially covering the second resonator to allow at least the open end of the second resonator to be covered therewith; a third shielding electrode and a fourth shielding electrode, the third shielding electrode being provided between the third resonator and the second substrate and partially covering the third resonator to allow at least the open end of the third resonator to be covered therewith, and the fourth shielding electrode being provided between the fourth resonator and the first substrate and partially covering the fourth resonator to allow at least the open end of the fourth resonator to be covered therewith; a first signal-lead electrode provided in the first substrate, the first signal-lead electrode being physically and directly connected to the first resonator, or being electromagnetically coupled to the first resonance section while providing a spacing between the first signal-lead electrode and the first resonance section; and a second signal-lead electrode provided in the second substrate, the second signal-lead electrode being physically and directly connected to the fourth resonator, or being electromagnetically coupled to the second resonance section while providing a spacing between the second signal-lead electrode and the second resonance section. The signal transmission is performed between the first substrate and the second substrate.

In the signal transmission device, the filter, and the inter-substrate communication device according to the embodiments of the technology, the open end, on which an electric field energy concentrates at the time of resonance, of the first resonator is covered with the first shielding electrode. Thereby, an electric field distribution that generates from the first resonator toward the second substrate reduces significantly across the first shielding electrode. Similarly, the open end, on which the electric field energy concentrates at the time of resonance, of the second resonator is also covered with the second shielding electrode. Thereby, the electric field distribution that generates from the second resonator toward the first substrate reduces significantly across the second shielding electrode. Thus, the optimization of sizes of the shielding electrodes allows the first resonator and the second resonator of the first resonance section to be placed in a state of the electromagnetic coupling primarily involving a magnetic field component (a magnetic field coupling). The electric field distribution is thus reduced significantly in an element such as, but not limited to, a layer of air between the first substrate and the second substrate in the first resonance section, thereby making it possible to suppress a variation in a resonance frequency in the first resonance section even when a variation is occurred in an inter-substrate distance of the element such as, but not limited to, the air layer between the first substrate and the second substrate. Likewise, the open end, on which the electric field energy concentrates at the time of resonance, of the third resonator is covered with the third shielding electrode. Thereby, the electric field distribution that generates from the third resonator toward the second substrate reduces significantly across the third shielding electrode. Similarly, the open end, on which the electric field energy concentrates at the time of resonance, of the fourth resonator is also covered with the fourth shielding electrode. Thereby, the electric field distribution that generates from the fourth resonator toward the first substrate reduces significantly across the fourth shielding electrode. Thus, the optimization of sizes of the shielding electrodes allows the third resonator and the fourth resonator of the second resonance section to be placed in the state of the electromagnetic coupling primarily involving the magnetic field component (the magnetic field coupling). The electric field distribution is thus reduced significantly in an element such as, but not limited to, the air layer between the first substrate and the second substrate in the second resonance section, thereby making it possible to suppress a variation in a resonance frequency in the second resonance section even when the variation is occurred in the inter-substrate distance of the element such as, but not limited to, the air layer between the first substrate and the second substrate. Hence, a variation in factors such as a pass frequency and a pass band caused by the variation in the inter-substrate distance is suppressed.

Advantageously, in the signal transmission device, the filter, and the inter-substrate communication device, each of the first resonator and the second resonator is a line resonator having a first end serving as the open end and a second end serving as a short-circuit end, the open end has a line width wider than that in the short-circuit end, the first shielding electrode is provided to cover at least a wider line width region in the first resonator, and the second shielding electrode is provided to cover at least a wider line width region in the second resonator. Alternatively, each of the first resonator and the second resonator is a line resonator having a couple of ends each serving as the open end, each of the open ends has a line width wider than that of a central portion thereof, the first shielding electrode is provided to cover at least a wider line width region in the first resonator, and the second shielding electrode is provided to cover at least a wider line width region in the second resonator.

Advantageously, a first capacitor electrode electrically connected to the open end of the first resonator, and provided between the open end of the first resonator and the first shielding electrode; and a second capacitor electrode electrically connected to the open end of the second resonator, and provided between the open end of the second resonator and the second shielding electrode, may be further included.

Advantageously, a first coupling window provided between the first resonator and the second substrate, and allows the first resonator and the second resonator to be electromagnetically coupled; and a second coupling window provided between the second resonator and the first substrate, and allows the first resonator and the second resonator to be electromagnetically coupled, may be further included.

Advantageously, the first resonance section works as a single coupled-resonator which resonates, as a whole, at a predetermined resonance frequency when the first and second resonators are electromagnetically coupled to each other in a hybrid resonance mode, and each of the first and second resonators resonates at a resonance frequency different from the predetermined resonance frequency when the first and the second substrates are separated away from each other to fail to be electromagnetically coupled to each other, and the second resonance section works as another single coupled-resonator which resonates, as a whole, at the predetermined resonance frequency when the third and fourth resonators are electromagnetically coupled to each other in a hybrid resonance mode, and each of the third and fourth resonators resonates at a resonance frequency different from the predetermined resonance frequency when the first and the second substrates are separated away from each other to fail to be electromagnetically coupled to each other.

According to this embodiment, a frequency characteristic in the state where the first substrate and the second substrate are separated away from each other to fail to be electromagnetically coupled to each other, and a frequency characteristic in the state where the first substrate and the second substrate are electromagnetically coupled to each other, become different. Thereby, when the first substrate and the second substrate are electromagnetically coupled to each other, the signal transmission is performed based on the predetermined resonance frequency, for example. On the other hand, when the first substrate and the second substrate are separated away from each other to fail to be electromagnetically coupled to each other, the signal transmission is not performed based on the predetermined resonance frequency. Hence, it is possible to prevent a leakage of signal from the respective resonators provided for the substrates in the state where the first substrate and the second substrate are separated away from each other.

Advantageously, the signal transmission device and the filter each may further include: a first signal-lead electrode provided in the first substrate, the first signal-lead electrode being physically and directly connected to the first resonator, or being electromagnetically coupled to the first resonance section while providing a spacing between the first signal-lead electrode and the first resonance section; and a second signal-lead electrode provided in the second substrate, the second signal-lead electrode being physically and directly connected to the fourth resonator, or being electromagnetically coupled to the second resonance section while providing a spacing between the second signal-lead electrode and the second resonance section. The signal transmission is performed between the first substrate and the second substrate.

Advantageously, the signal transmission device and the filter each may further include: a first signal-lead electrode provided in the second substrate, the first signal-lead electrode being physically and directly connected to the second resonator, or being electromagnetically coupled to the first resonance section while providing a spacing between the first signal-lead electrode and the first resonance section; and a second signal-lead electrode provided in the second substrate, the second signal-lead electrode being physically and directly connected to the fourth resonator, or being electromagnetically coupled to the second resonance section while providing a spacing between the second signal-lead electrode and the second resonance section. The signal transmission is performed within the second substrate.

As used herein, the term "signal transmission" in the signal transmission device, the filter, and the inter-substrate communication device according to the embodiments of the technology refers not only to a signal transmission for transmitting and receiving a signal such as an analog signal and a digital signal, but also refers to a power transmission used for transmitting and receiving electric power.

According to the signal transmission device, the filter, and the inter-substrate communication device of the embodiments of the technology, a resonator structure in which a region in the open end, on which the electric field energy concentrates in the resonance, is covered with the shielding electrode is employed for the respective resonators provided for the first substrate and the second substrate. Thus, the optimization of sizes of the shielding electrodes allows the electromagnetic coupling primarily involving the magnetic field component to be established between the first substrate and the second substrate, making it possible to significantly reduce the electric field distribution in an element such as, but not limited to, the air layer. Thereby, it is possible to suppress a variation in a resonance frequency in the first resonance section and in the second resonance section even when a variation is occurred in the inter-substrate distance of the element such as, but not limited to, the air layer between the first substrate and the second substrate. Hence, it is possible to suppress a variation in factors such as the pass frequency and the pass band caused by the variation in the inter-substrate distance.

It is to be understood that both the foregoing general description and the following detailed description are exemplary, and are intended to provide further explanation of the technology as claimed.

BRIEF DESCRIPTION OF THE DRAWINGS

The patent or application file contains at least one drawing executed in color. Copies of this patent of patent application publication with color drawing(s) will be provided by the Office upon request and payment of the necessary fee. The accompanying drawings are included to provide a further understanding of the disclosure, and are incorporated in and constitute a part of this specification. The drawings illustrate embodiments and, together with the specification, serve to explain the principles of the technology.

Figure 8:
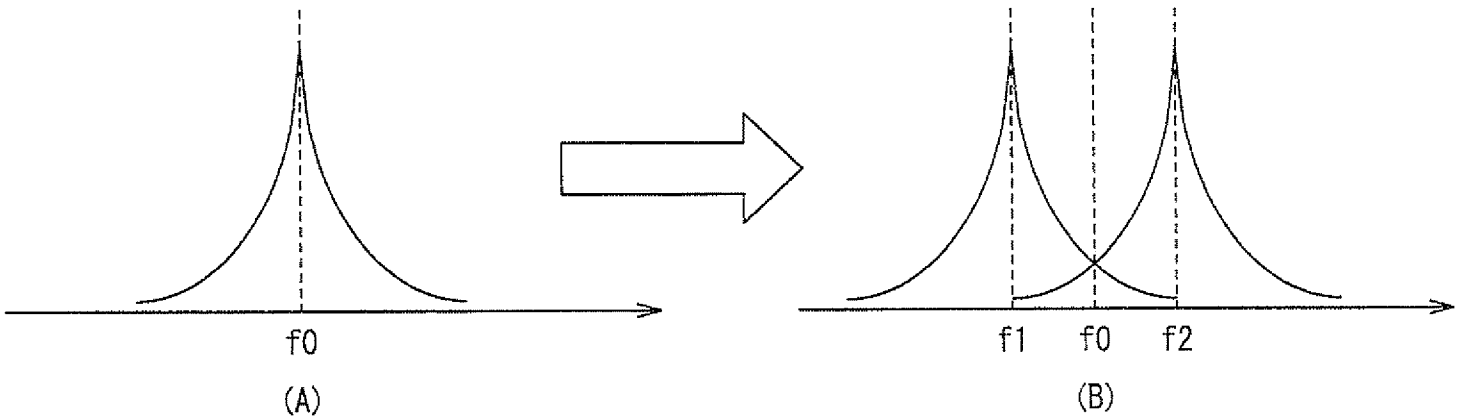

(A) of FIG. 8 describes a resonance frequency derived from a single resonator, and (B) of FIG. 8 describes resonance frequencies derived from two resonators.

Figure 9:
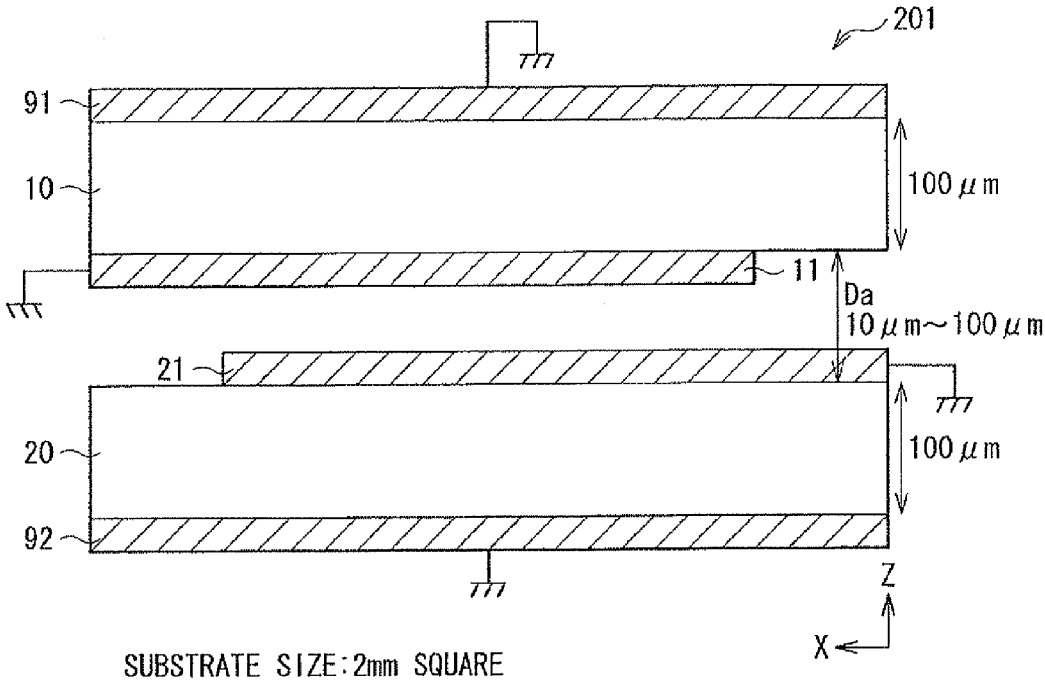

FIG. 9 is a cross-sectional view illustrating a specific design example of the resonator structure according to the comparative example.

Figure 10:
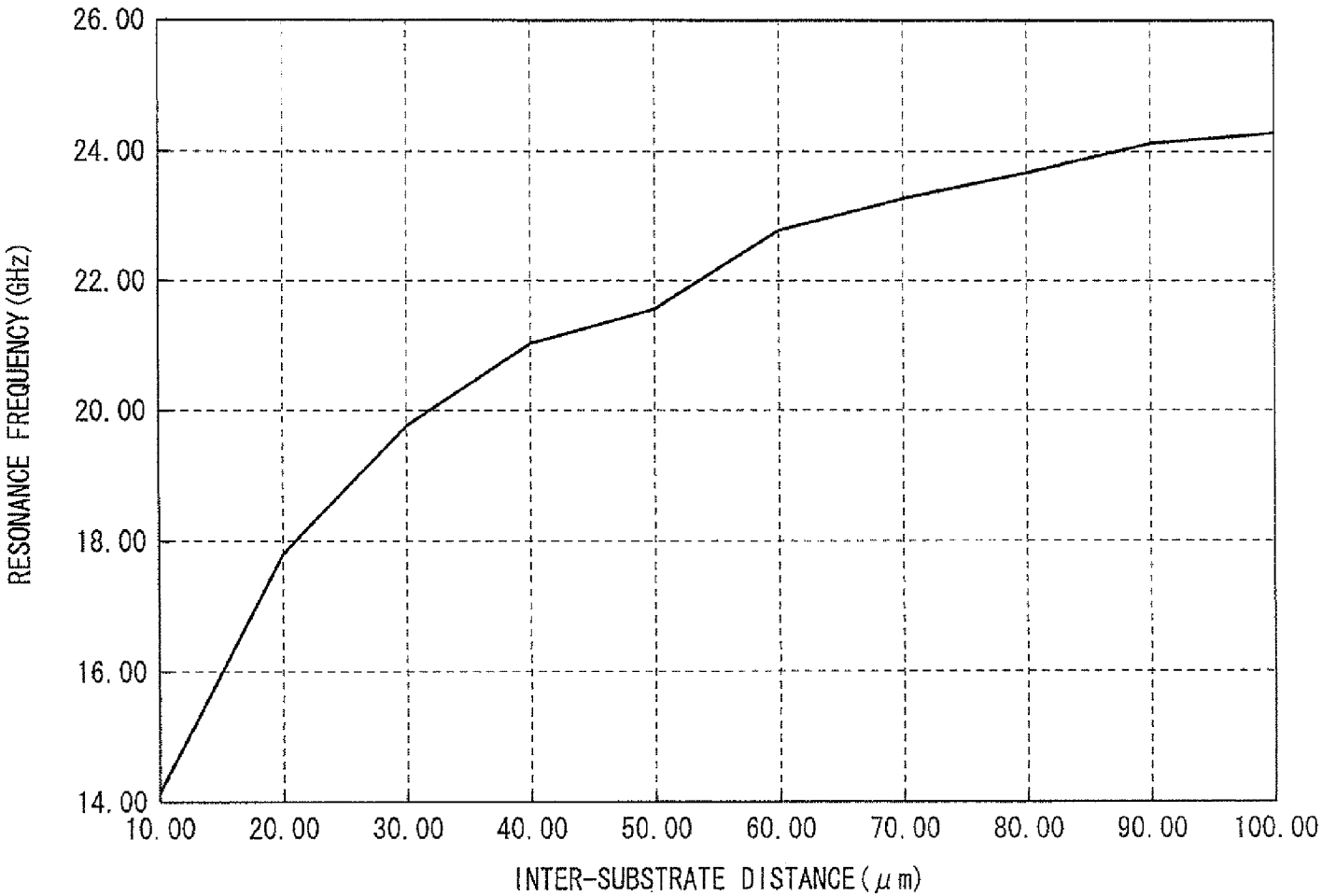

FIG. 10 is a characteristic diagram representing a resonance frequency characteristic of the resonator structure illustrated in FIG. 9.

Figure 1:
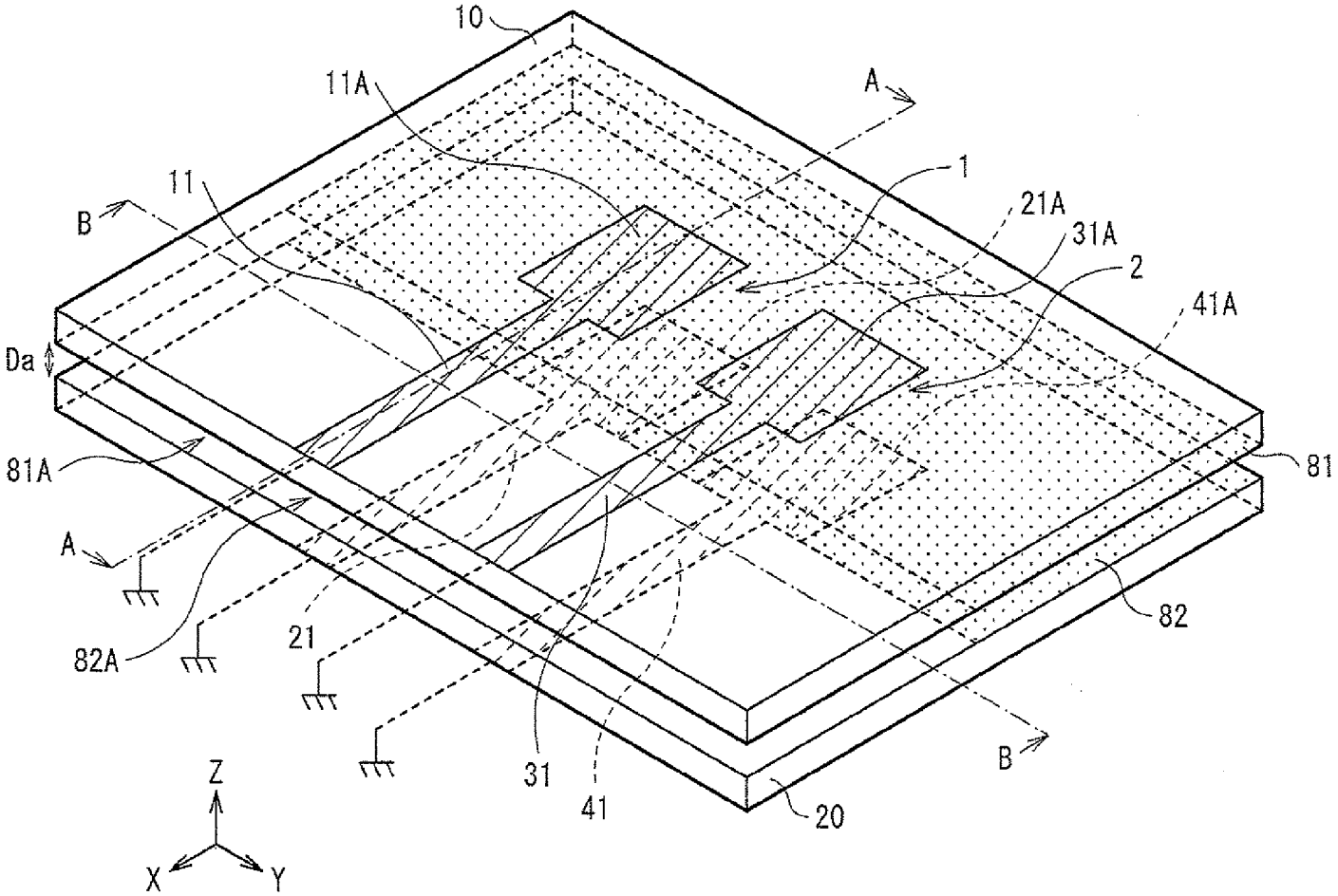
FIG. 1 is a perspective view illustrating an exemplary configuration of a signal transmission device (applicable also to a filter and an inter-substrate communication device) according to a first embodiment of the technology.
Figure 11:
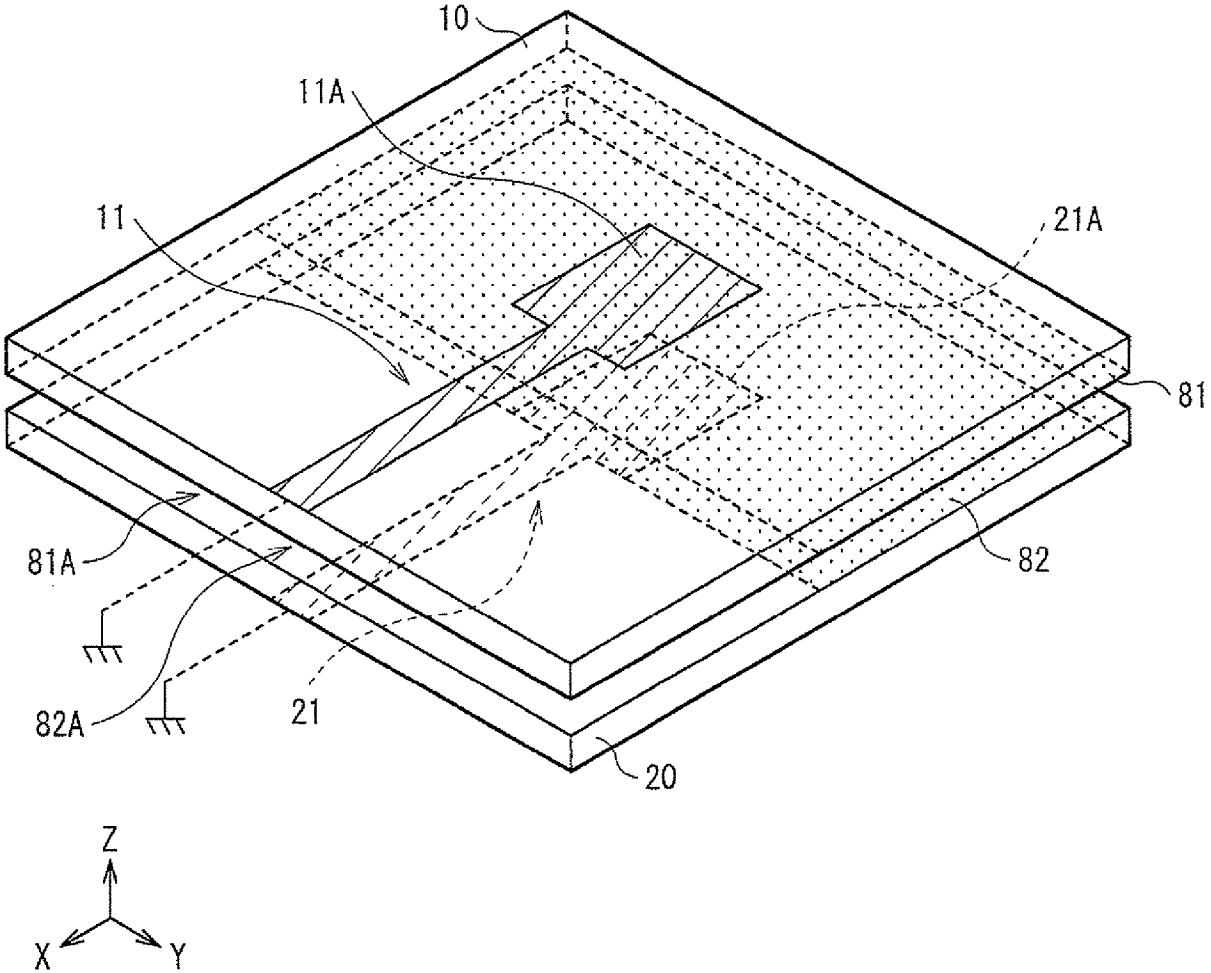

FIG. 11 is a cross-sectional view illustrating a specific design example of a first resonance section in the signal transmission device illustrated in FIG. 1.

Figure 12:
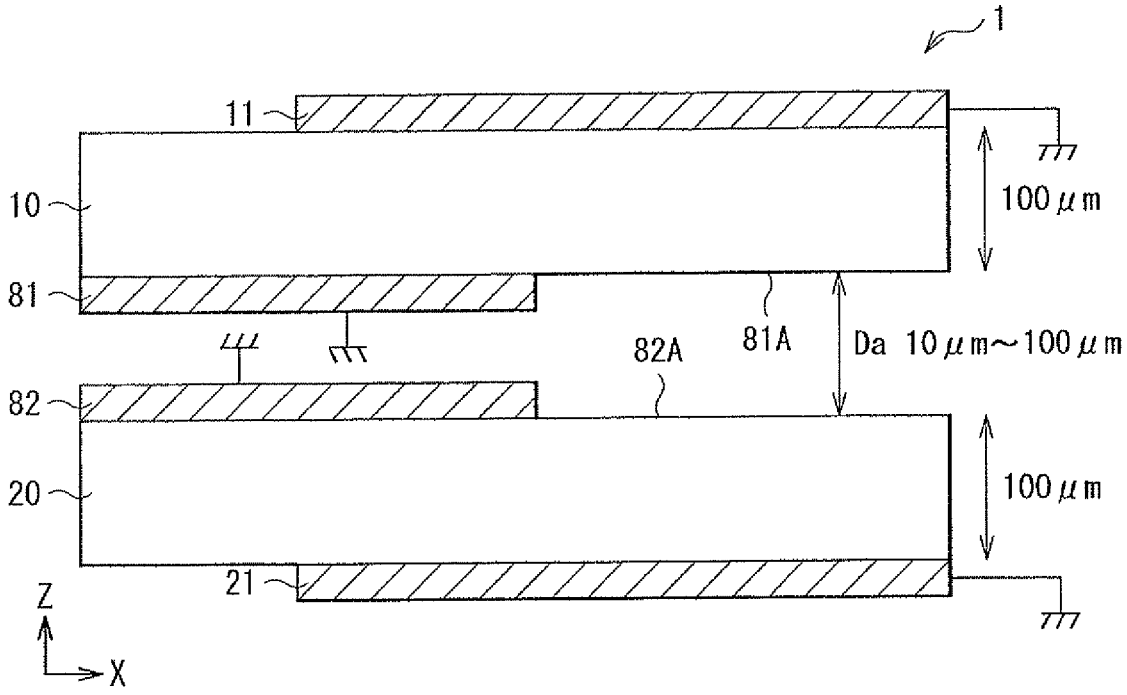

FIG. 12 is a cross-sectional view indicating specific design values of the first resonance section illustrated in FIG. 11.

Figure 13:
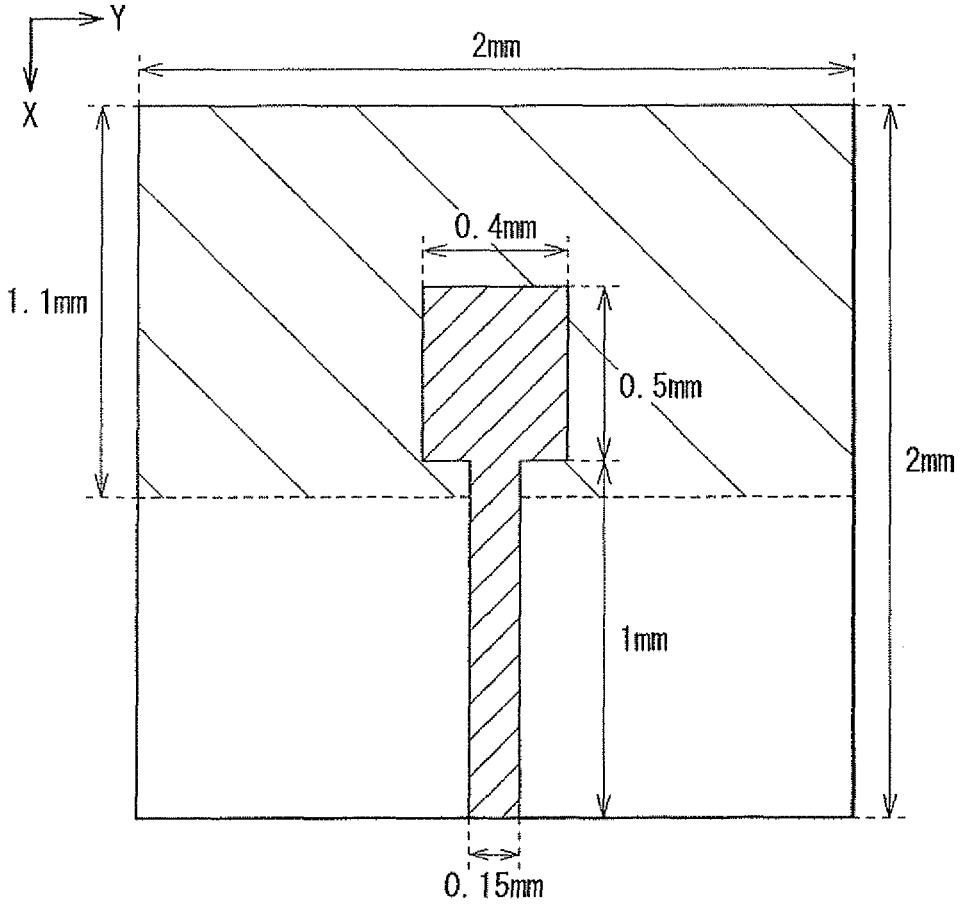

FIG. 13 is a plan view indicating specific design values of the first resonance section illustrated in FIG. 11.

Figure 14:
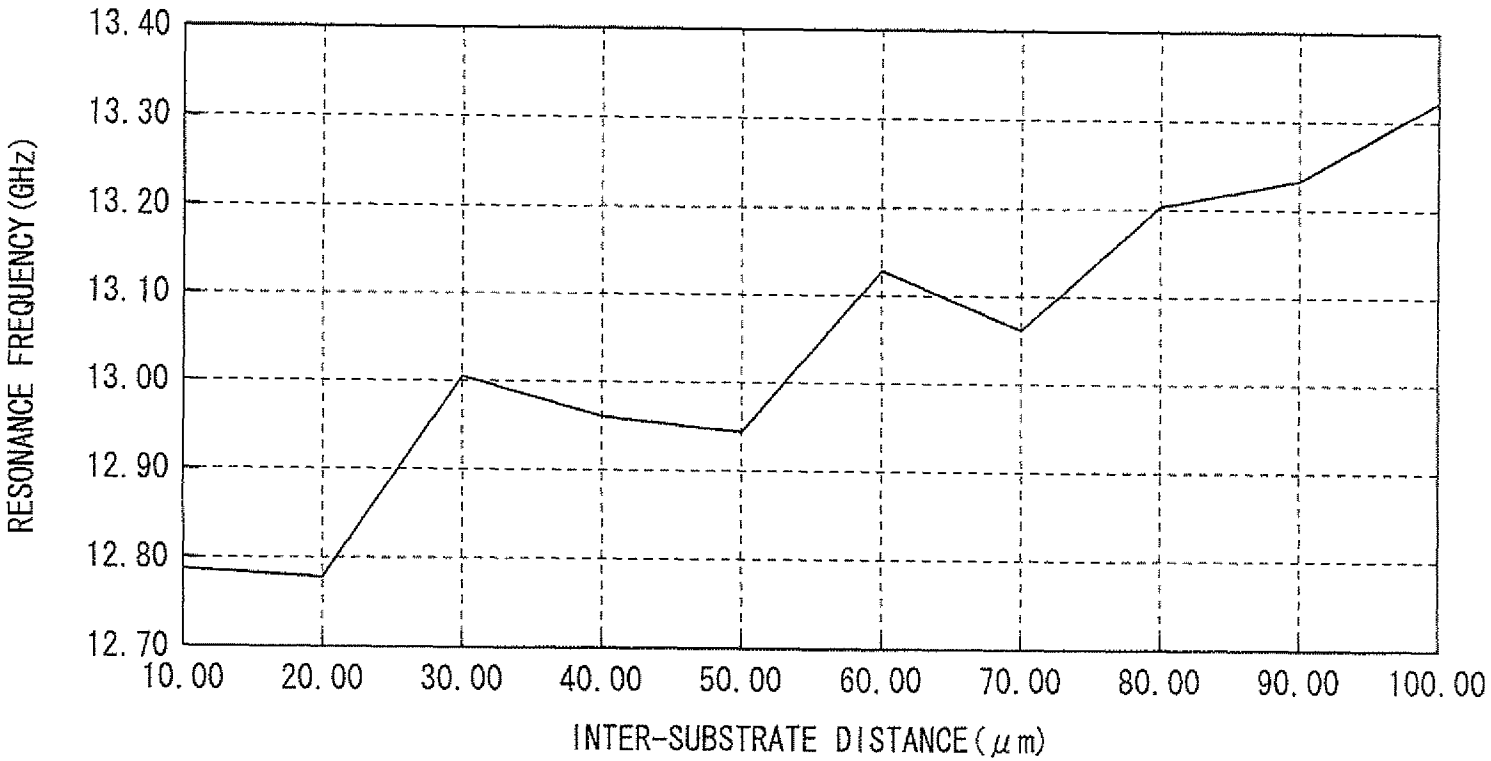

FIG. 14 is a characteristic diagram representing a resonance frequency characteristic of the first resonance section illustrated in FIG. 11.

Figure 15:
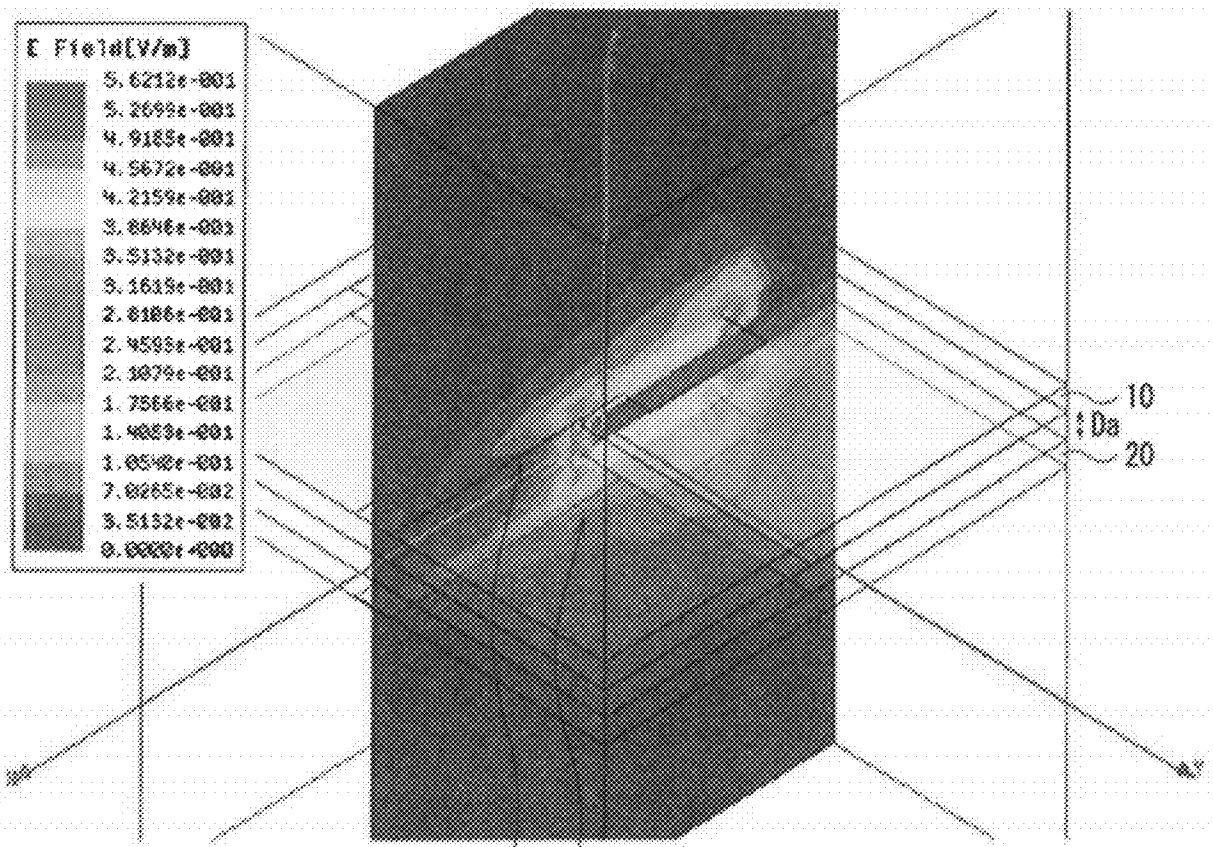

FIG. 15 describes an electric field intensity distribution between a first substrate and a second substrate in the first resonance section illustrated in FIG. 11.

Figure 16:
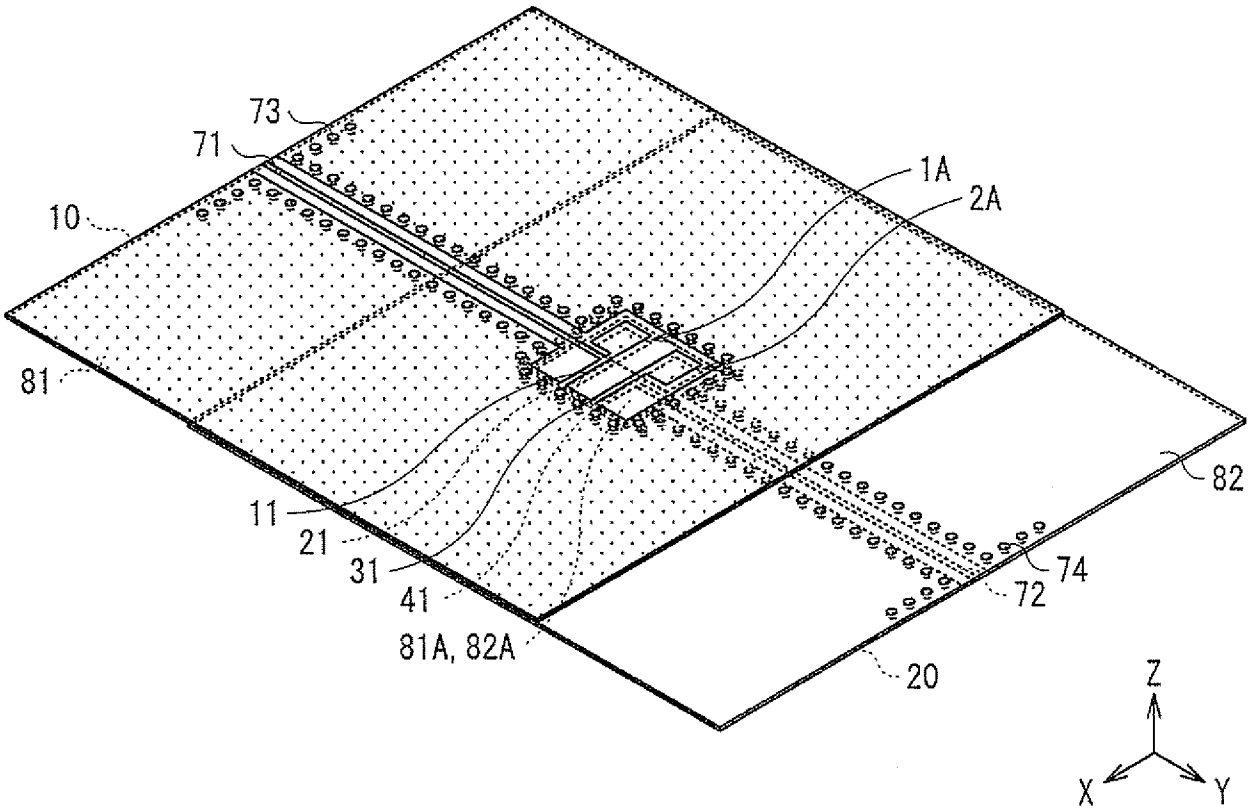

FIG. 16 is a perspective view illustrating an exemplary configuration of a filter to which the resonator structure of the signal transmission device illustrated in FIG. 1 is applied.

Figure 17A:
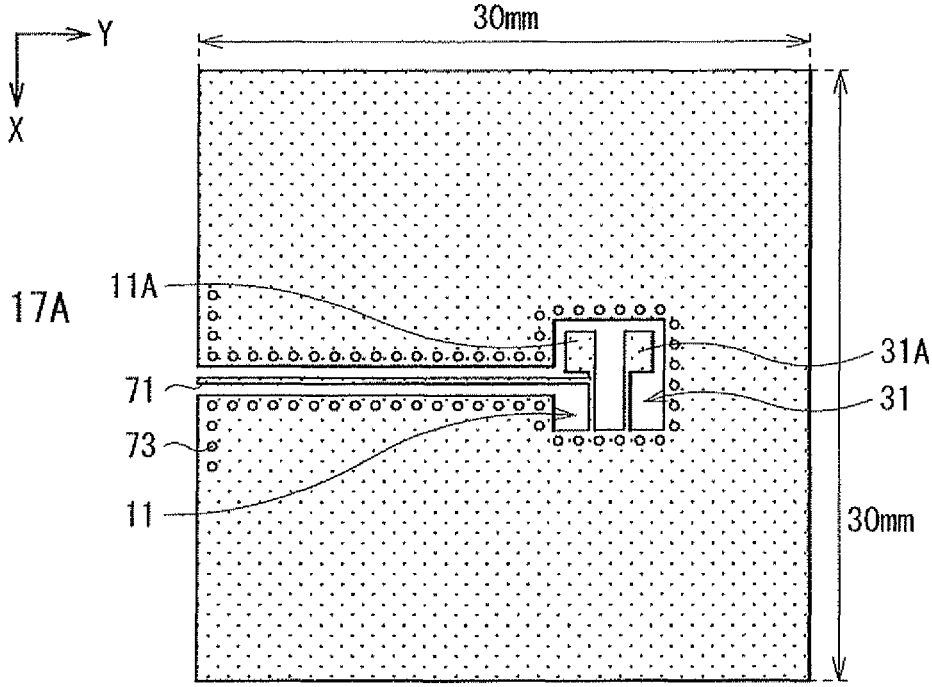
Figure 17B:
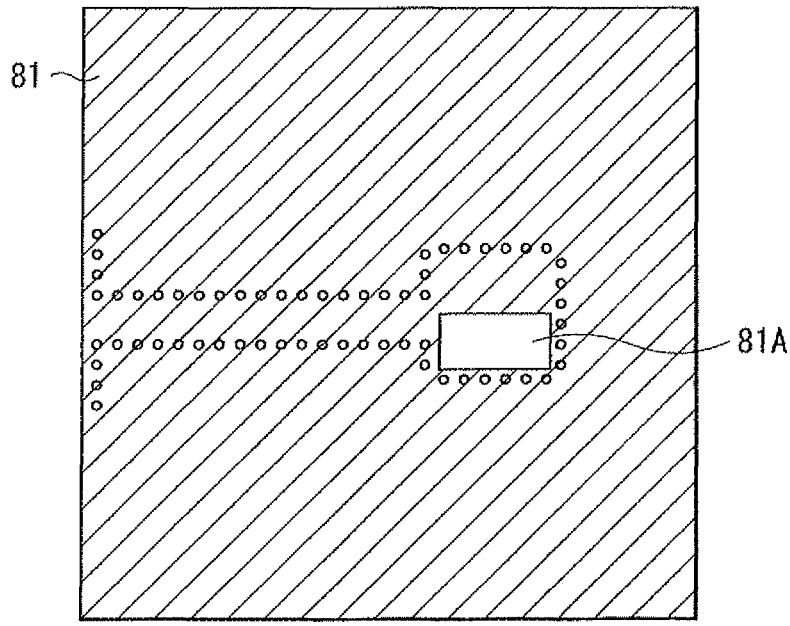

FIG. 17A is a plan view illustrating a configuration of the front of a first substrate in the filter illustrated in FIG. 16, and FIG. 17B is a plan view illustrating a configuration of the back of the first substrate.

Figure 18A:
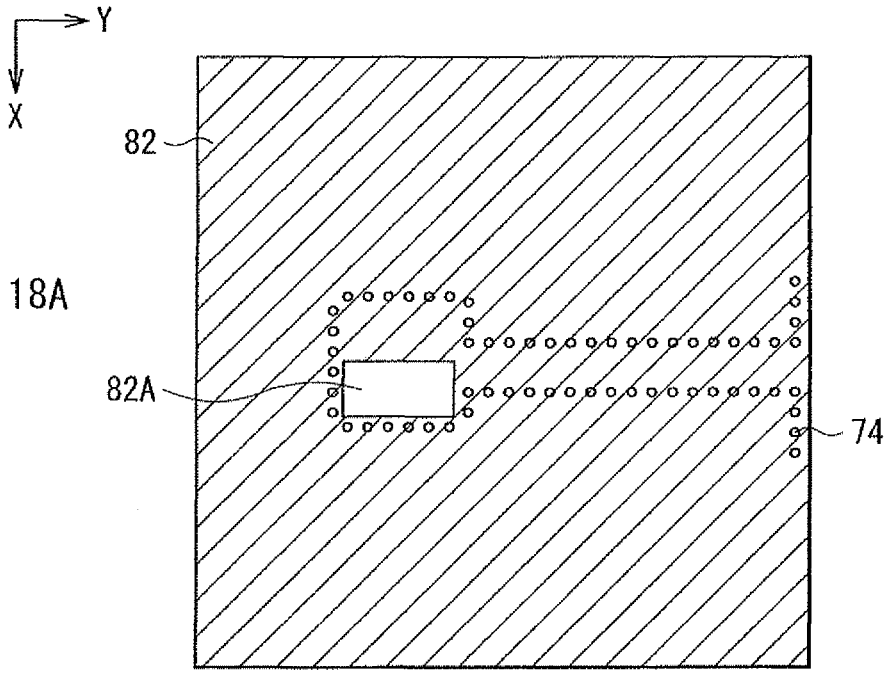
Figure 18B:
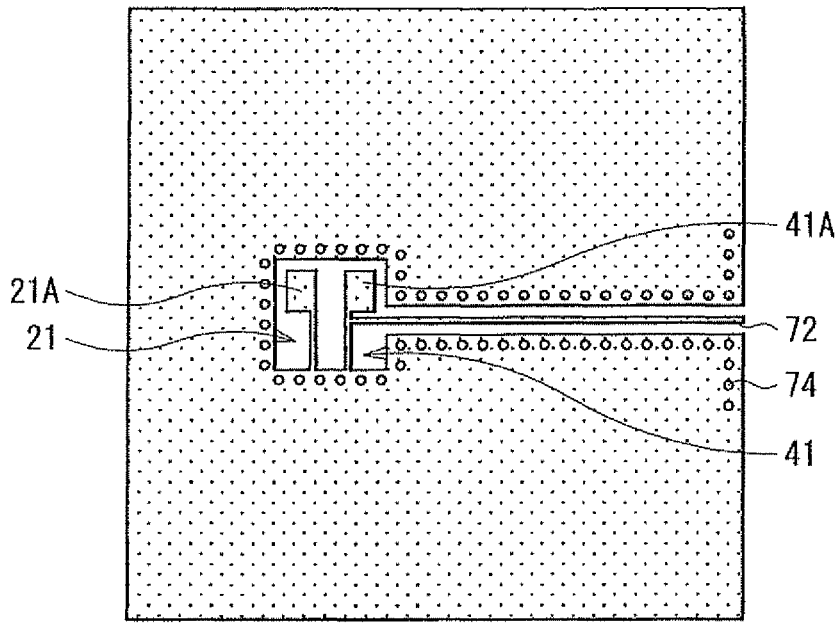

FIG. 18A is a plan view illustrating a configuration of the front of a second substrate in the filter illustrated in FIG. 16, and FIG. 18B is a plan view illustrating a configuration of the back of the second substrate.

Figure 19:
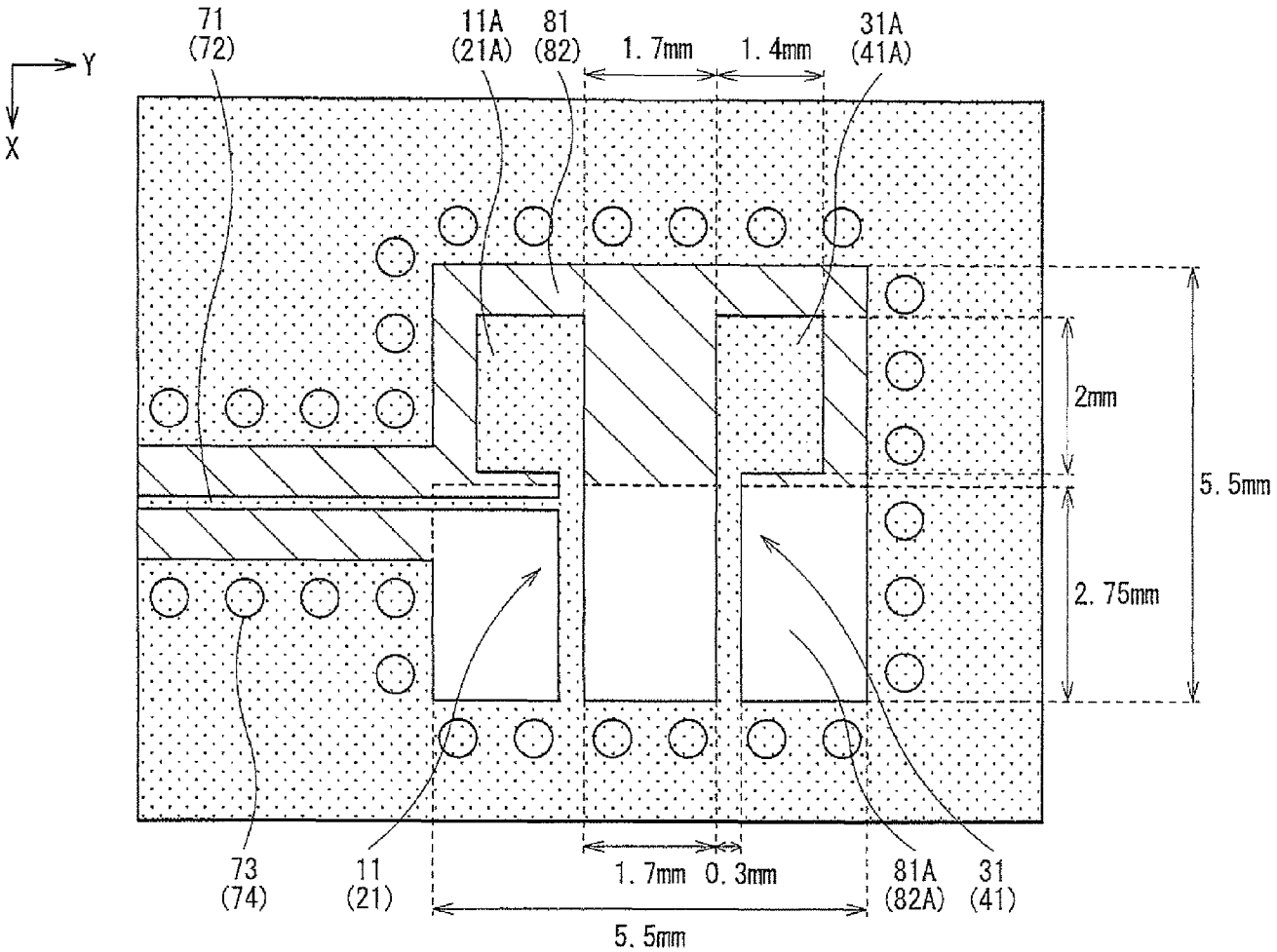

FIG. 19 is a plan view illustrating specific design values of resonator sections in the filter illustrated in FIG. 16.

Figure 20:
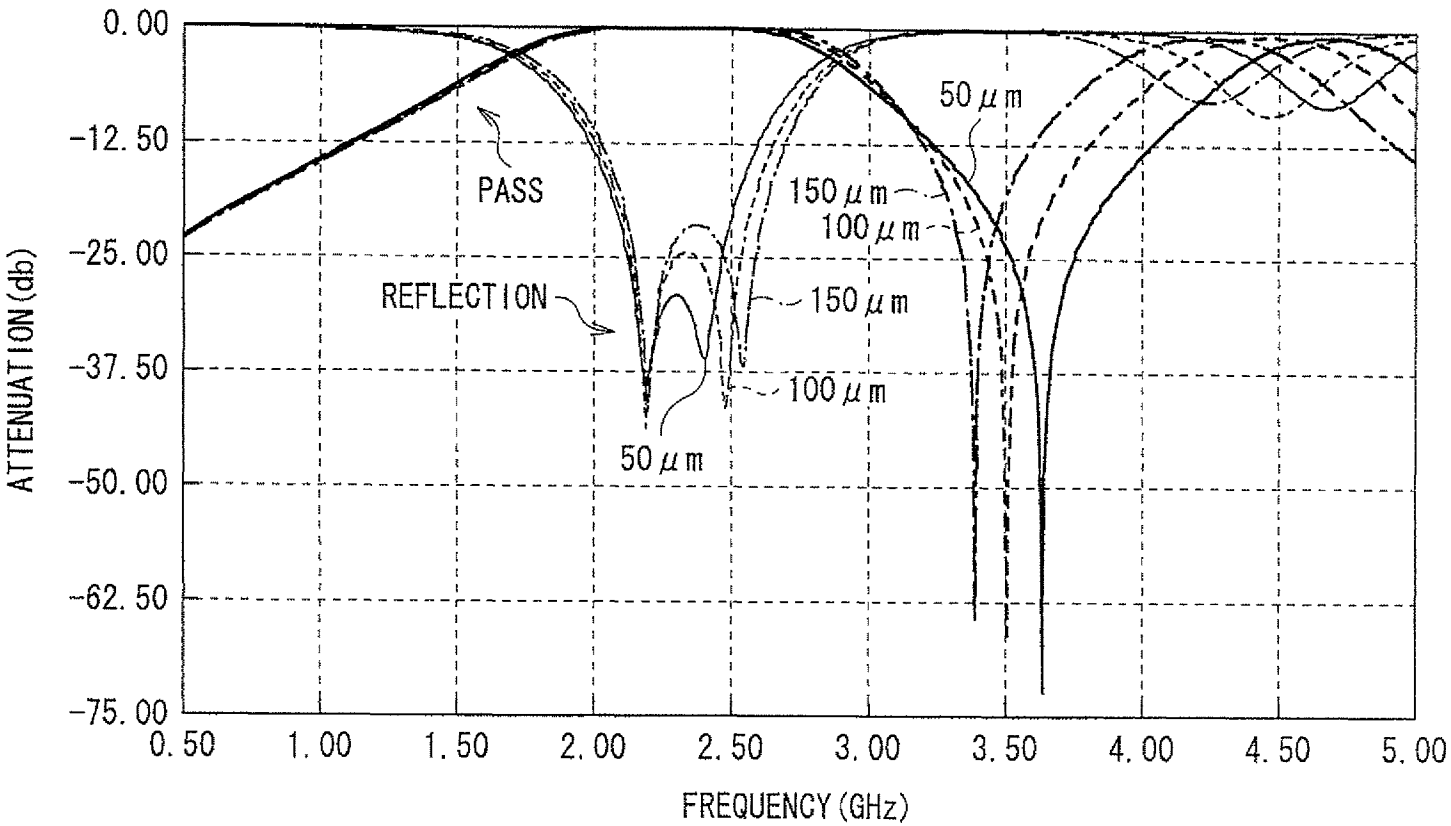

FIG. 20 is a characteristic diagram representing a filter characteristic of the filter illustrated in FIG. 16.

Figure 21:
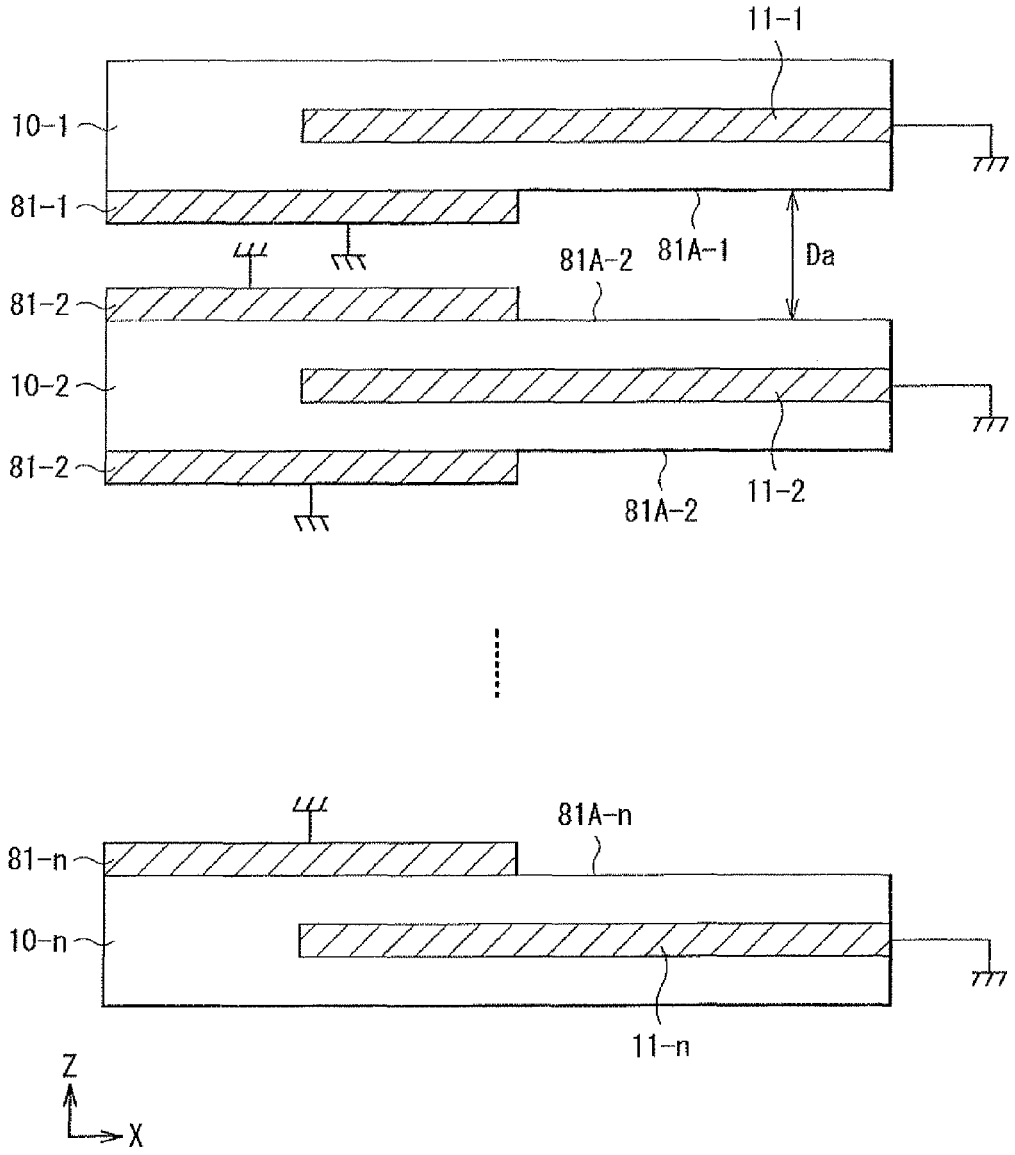

FIG. 21 is a cross-sectional view illustrating an exemplary configuration of a signal transmission device according to a second embodiment of the technology.

Figure 22:
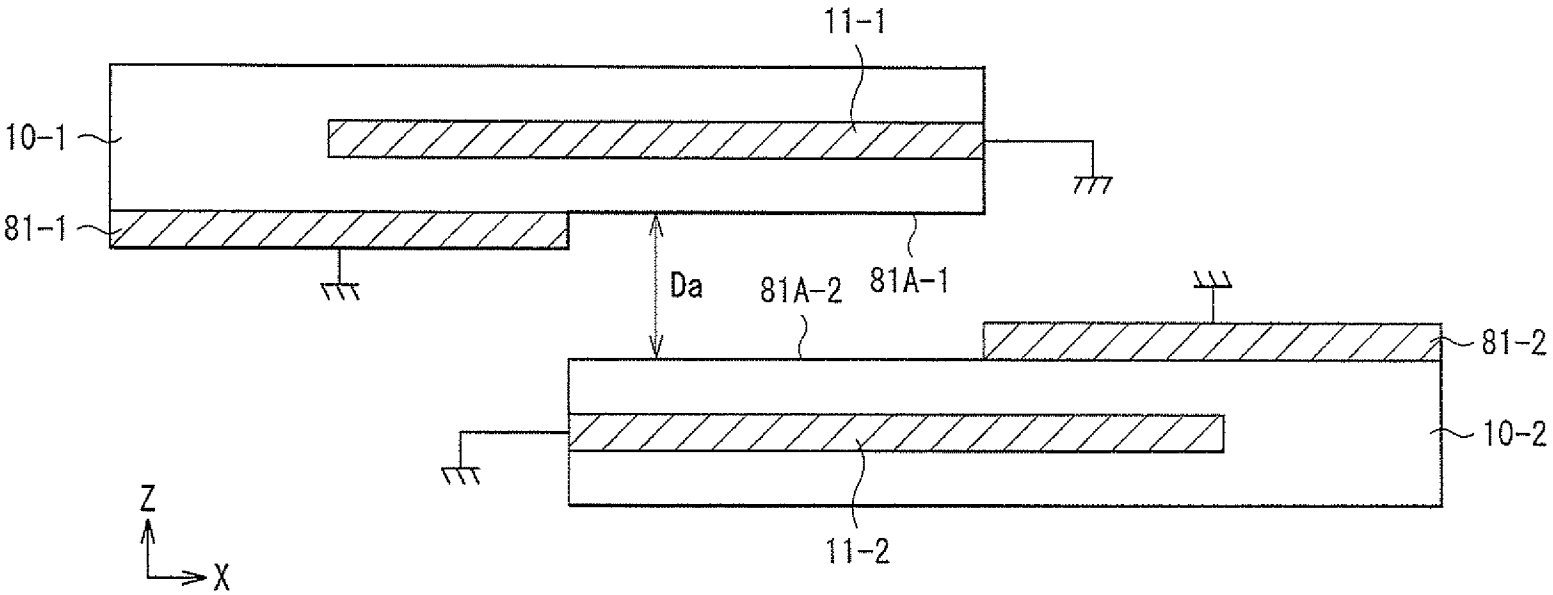

FIG. 22 is a cross-sectional view illustrating an exemplary configuration of a signal transmission device according to a third embodiment of the technology.

Figure 23:
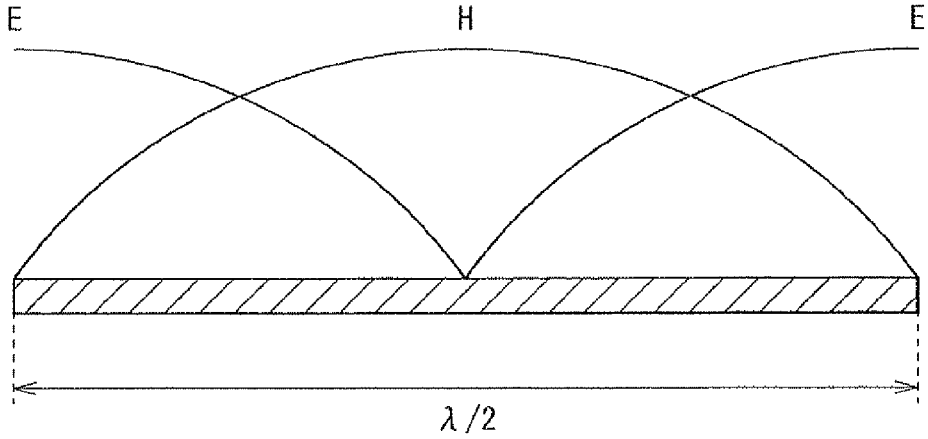

FIG. 23 describes an electric field intensity distribution and a magnetic field intensity distribution in a half wavelength resonator.

Figure 24:
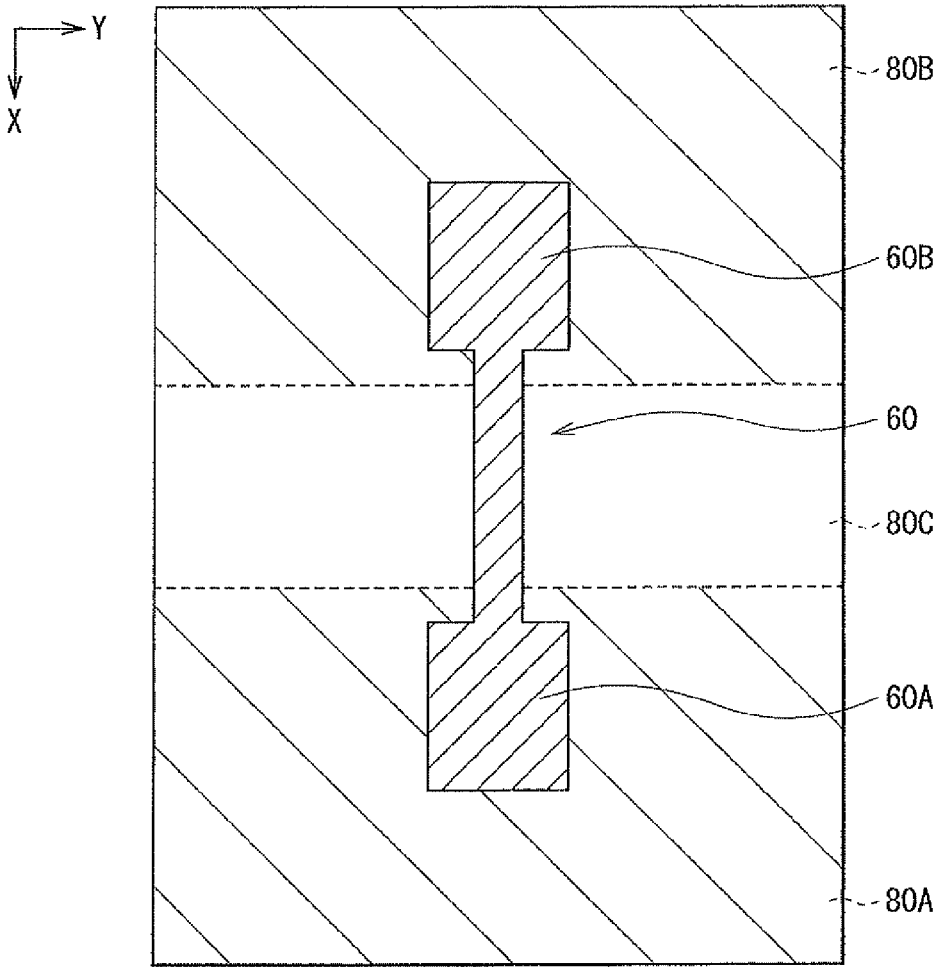

FIG. 24 is a plan view illustrating an exemplary configuration of a signal transmission device according to a fourth embodiment of the technology.

Figure 25:
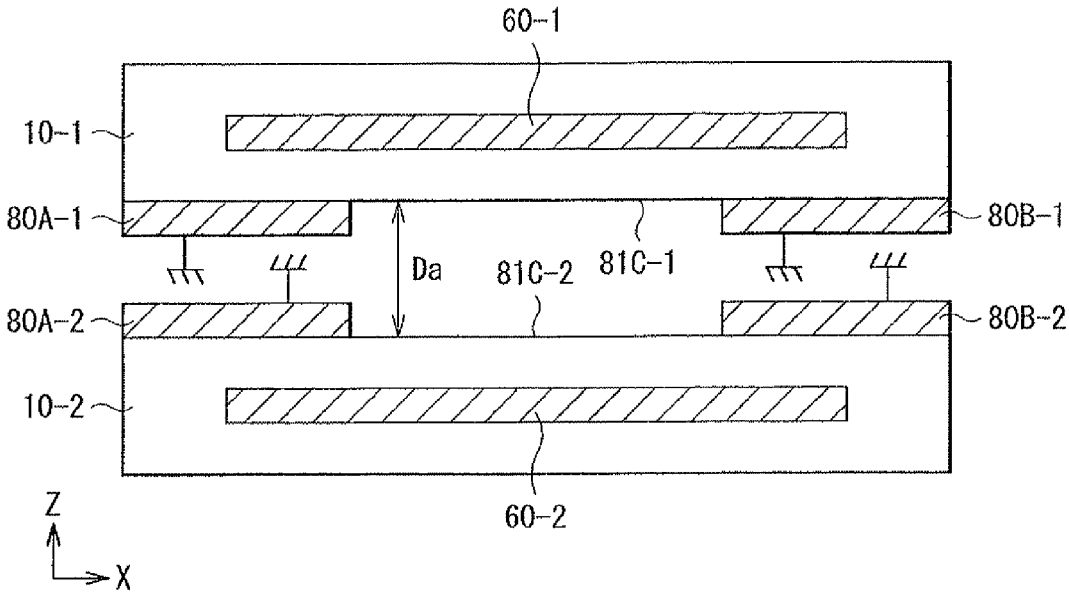

FIG. 25 is a cross-sectional view illustrating the exemplary configuration of the signal transmission device according to the fourth embodiment.

Figure 26:
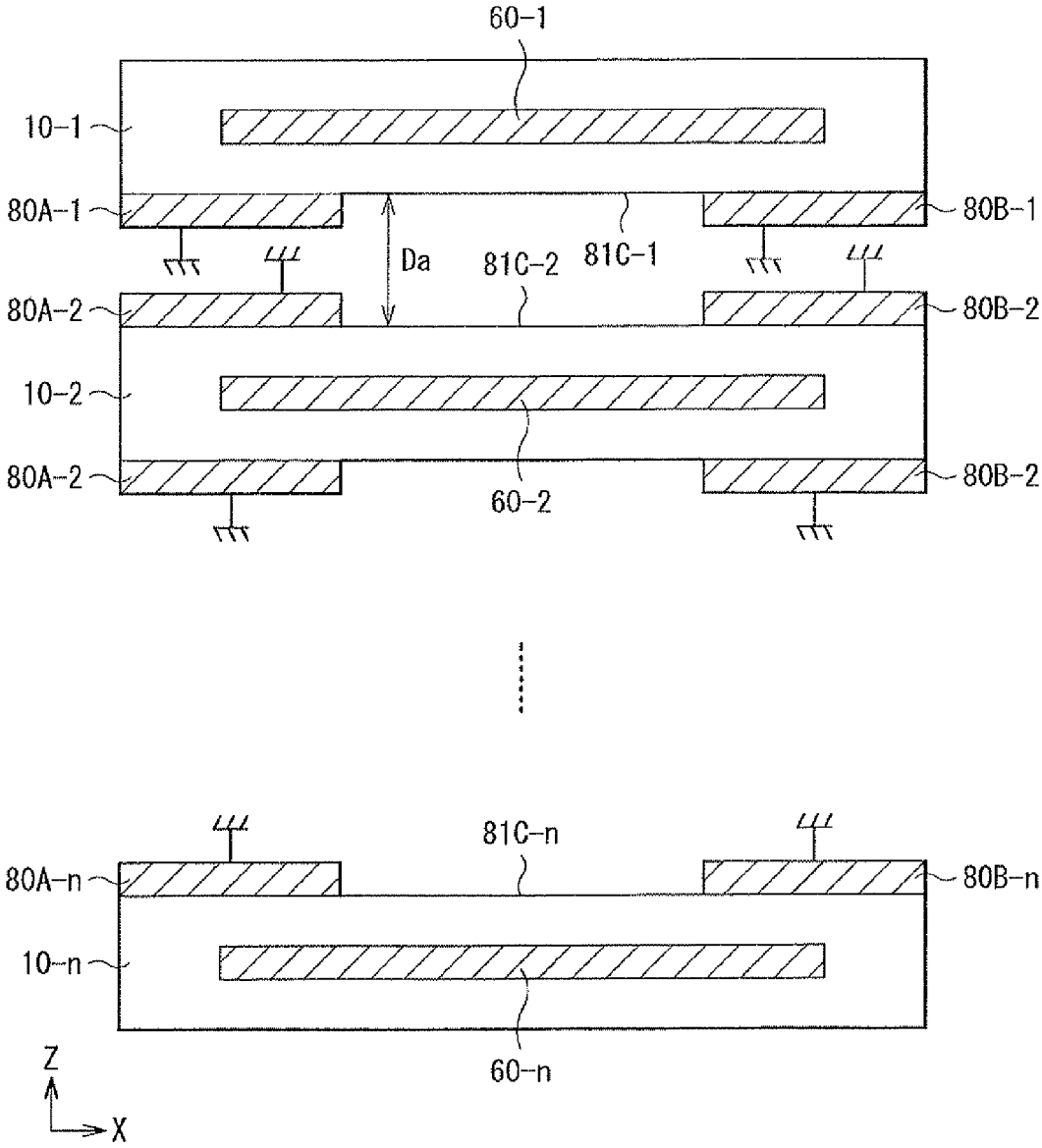

FIG. 26 is a cross-sectional view illustrating an exemplary configuration of a signal transmission device according to a fifth embodiment of the technology.

Figure 27:
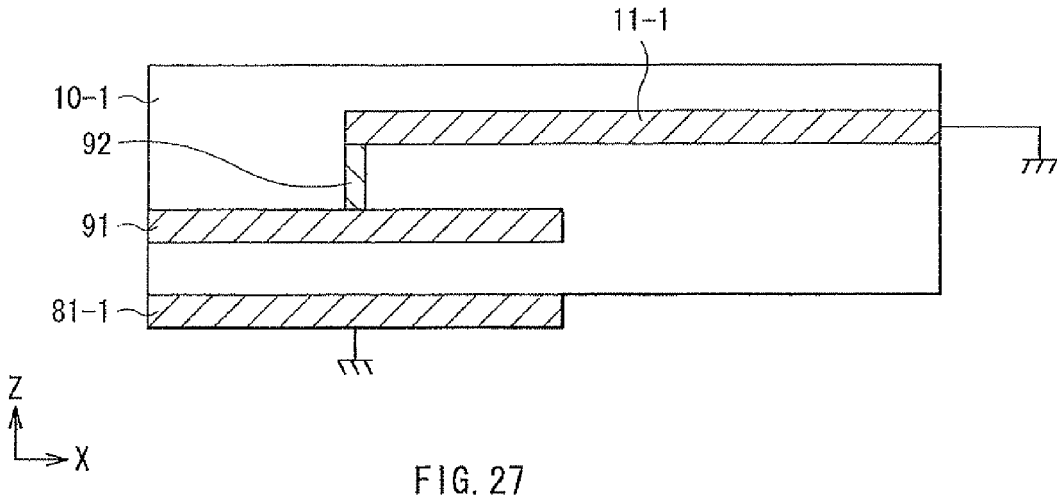

FIG. 27 is a cross-sectional view illustrating a first exemplary configuration of a signal transmission device according to a sixth embodiment of the technology.

Figure 28:
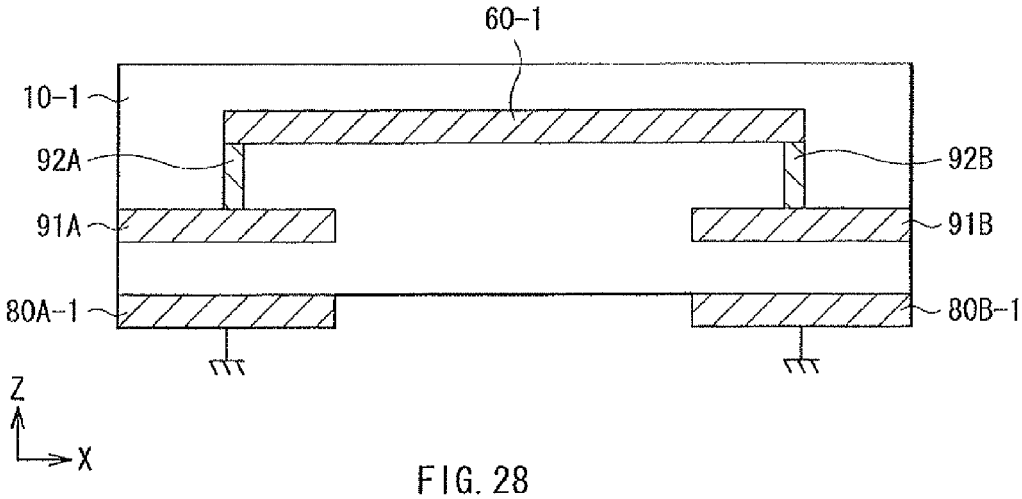

FIG. 28 is a cross-sectional view illustrating a second exemplary configuration of the signal transmission device according to the sixth embodiment.

Figure 29:
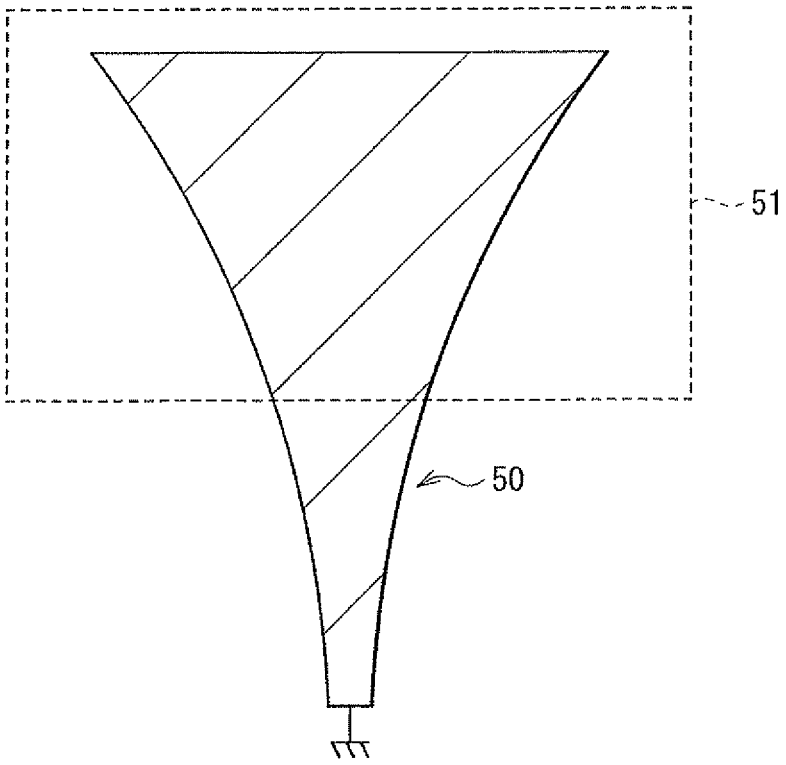

FIG. 29 is a plan view illustrating an exemplary configuration of a signal transmission device according to a seventh embodiment of the technology.

Figure 30:
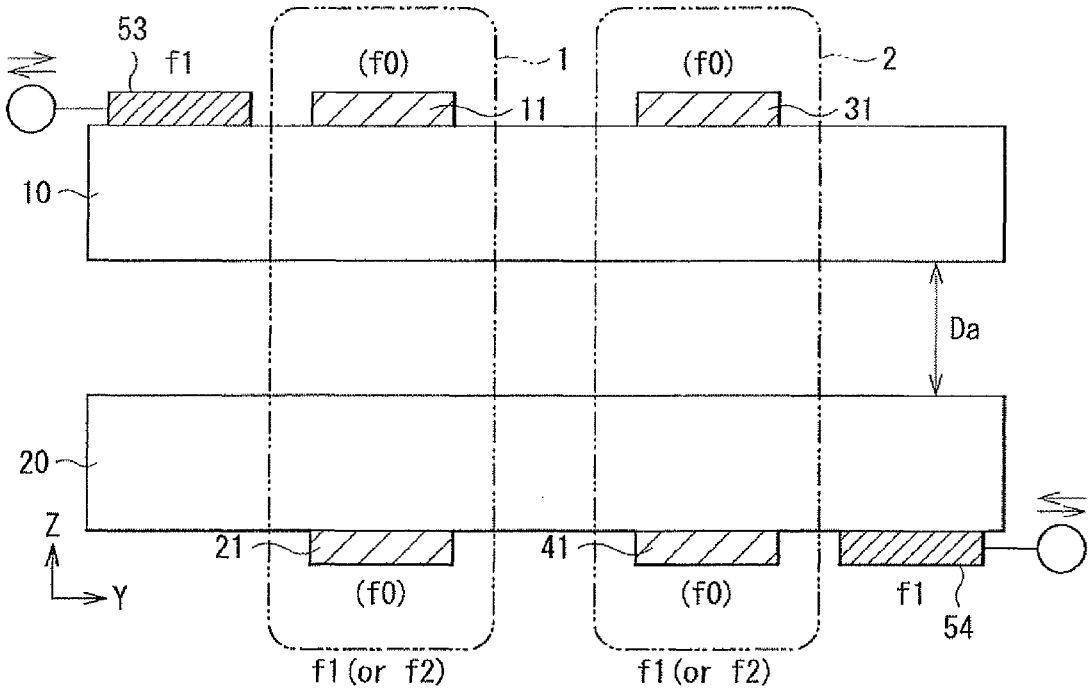

FIG. 30 is a cross-sectional view illustrating an exemplary configuration of a signal transmission device according to an eighth embodiment of the technology.

DETAILED DESCRIPTION

In the following, some embodiments of the technology will be described in detail with reference to the accompanying drawings.

First Embodiment

[Exemplary Configuration of Signal Transmission Device]

Figure 2:
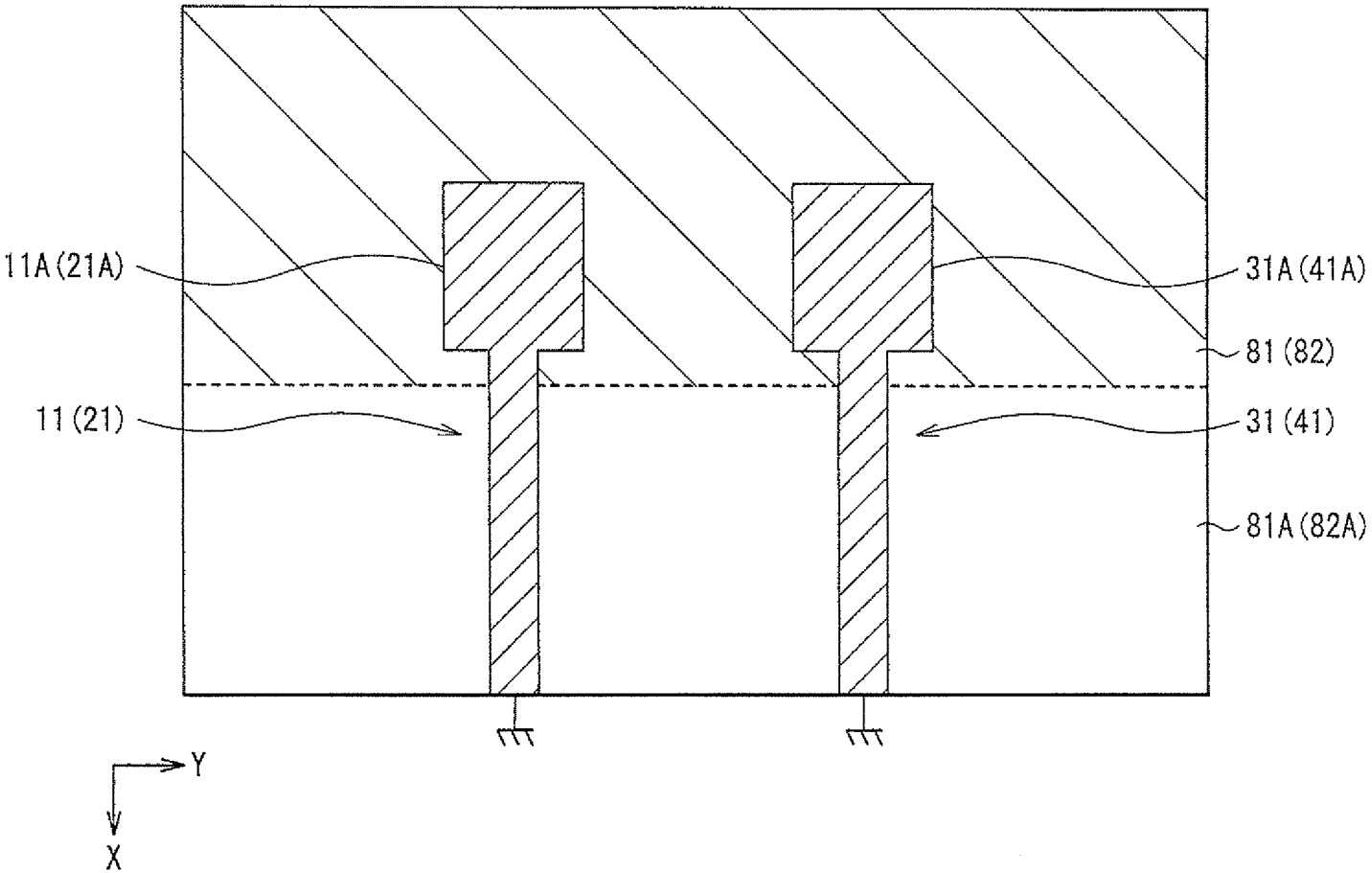
FIG. 2 is a plan view illustrating the signal transmission device illustrated in FIG. 1 as viewed from above.
Figure 3:
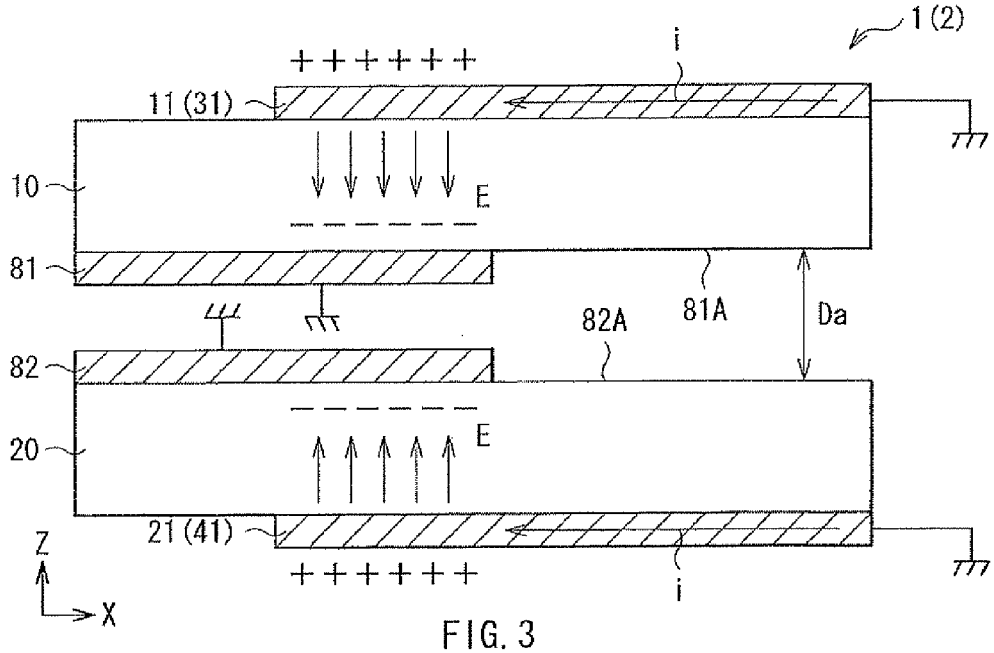
FIG. 3 is a cross-sectional view illustrating, together with an electric field vector "E" and a current vector "i" of each part of substrates, a cross-sectional configuration of the signal transmission device as taken along a line A-A in FIG. 1.
Figure 4:
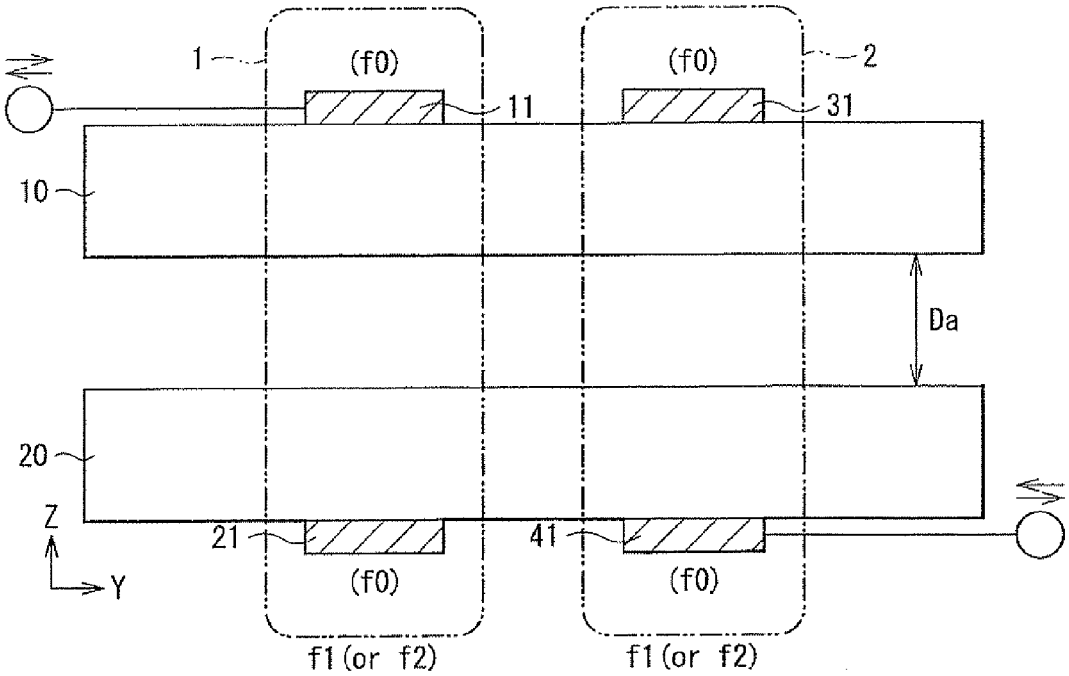
FIG. 4 is a cross-sectional view illustrating, together with a resonance frequency of each part of the substrates, a cross-sectional configuration of the signal transmission device as taken along a line B-B in FIG. 1.

FIG. 1 illustrates an overall exemplary configuration of a signal transmission device (applicable also to a filter and an inter-substrate communication device) according to a first embodiment of the technology. FIG. 2 illustrates a plan configuration of the signal transmission device illustrated in FIG. 1 as viewed from above. FIG. 3 illustrates a cross-sectional configuration of the signal transmission device as taken along a line A-A in FIG. 1. FIG. 4 illustrates a cross-sectional configuration of the signal transmission device as taken along a line B-B in FIG. 1.

The signal transmission device according to the first embodiment is provided with a first substrate 10 and a second substrate 20, which are disposed to oppose each other in a first direction (for example, a Z-direction in the drawing). The first substrate 10 and the second substrate 20 are each a dielectric substrate, and are so disposed to oppose each other, with a spacing in between (i.e., an inter-substrate distance Da), as to sandwich a layer made of a material different from a substrate material. The layer including the material different from the substrate material can be a layer having a dielectric constant different from that of the substrate material, such as, but not limited to, a layer of air.

The front of the first substrate 10 is formed with a first quarter wavelength resonator 11 in a first region, and a third quarter wavelength resonator 31 in a second region. As illustrated in FIGS. 1 and 2, the first quarter wavelength resonator 11 and the third quarter wavelength resonator 31 are formed in a side-by-side fashion in a second direction (for example, a Y-direction in the drawings). The back of the second substrate 20 is formed with a second quarter wavelength resonator 21 in a region corresponding to the first region in which the first quarter wavelength resonator 11 is formed, and a fourth quarter wavelength resonator 41 in a region corresponding to the second region in which the third quarter wavelength resonator 31 is formed. The second quarter wavelength resonator 21 and the fourth quarter wavelength resonator 41 are formed in a side-by-side fashion in the second direction (the Y-direction in the drawings). Each of the quarter wavelength resonators 11, 21, 31, and 41 is configured of an electrode pattern made of a conductor, and has a first end serving as an open end and a second end serving as a short-circuit end. It is to be noted that a thickness of each of the electrode patterns (such as the first quarter wavelength resonators 11) in the first substrate 10 and the second substrate 20 is omitted in FIG. 1.

Referring to FIG. 2, each of the quarter wavelength resonators 11, 21, 31, and 41 is a line resonator having a wider line width in the open end than in the short-circuit end thereof. Thus, the quarter wavelength resonators 11, 21, 31, and 41 have wide conductor section 11A, 21A, 31A, and 41A in the open ends thereof, respectively. Each of the quarter wavelength resonators 11, 21, 31, and 41 thus structures a step-impedance resonator (SIR).

The first quarter wavelength resonator 11 and the second quarter wavelength resonator 21 are so disposed that the respective open ends thereof are opposed to each other and the respective short-circuit ends thereof are opposed to each other. Likewise, the third quarter wavelength resonator 31 and the fourth quarter wavelength resonator 41 are so disposed that the respective open ends thereof are opposed to each other and the respective short-circuit ends thereof are opposed to each other. Thus, the first quarter wavelength resonator 11 in the first substrate 10 and the second quarter wavelength resonator 21 in the second substrate 20 are opposed to each other to be electromagnetically coupled to one another in a state in which the first substrate 10 and the second substrate 20 are disposed to oppose each other in the first direction, thereby structuring a first resonance section 1. Also, the third quarter wavelength resonator 31 in the first substrate 10 and the fourth quarter wavelength resonator 41 in the second substrate 20 are opposed to each other to be electromagnetically coupled to one another in a state in which the first substrate 10 and the second substrate 20 are disposed to oppose each other in the first direction, thereby structuring a second resonance section 2. Hence, the first resonance section 1 and the second resonance section 2 are disposed in a side-by-side fashion in the second direction in the state in which the first substrate 10 and the second substrate 20 are disposed to oppose each other in the first direction.

Referring to FIG. 4, the first resonance section 1 and the second resonance section 2 each resonate at a predetermined resonance frequency (a first resonance frequency f1 or a second resonance frequency f2 based on a hybrid resonance mode described later) to be electromagnetically coupled to each other. A signal transmission is performed between the first and the second resonance sections 1 and 2, in which, for example, a predetermined first resonance frequency (i.e., the first resonance frequency f1 based on the later-described hybrid resonance mode) is a pass band. In contrast, in a state where the first substrate 10 and the second substrate 20 are so separated away from each other that they do not electromagnetically coupled to each other, the quarter wavelength resonators 11, 21, 31, and 41 forming the first and the second resonance sections 1 and 2 each resonate at other resonance frequency f0 which is different from the predetermined resonance frequency.

The signal transmission device according to the first embodiment allows the signal transmission to be performed between the first substrate 10 and the second substrate 20, by forming on the first substrate 10 a first signal-lead electrode used for the first resonance section 1, and on the second substrate 20 a second signal-lead electrode used for the second resonance section 2. For example, the first signal-lead electrode may be formed on the front of the first substrate 10 and may be physically and directly connected to the first quarter wavelength resonator 11 so as to be electrically connected directly to the first quarter wavelength resonator 11, thereby allowing a signal transmission to be established between the first signal-lead electrode and the first resonance section 1. Also, the second signal-lead electrode may be formed on the back of the second substrate 20 and may be physically and directly connected to the fourth quarter wavelength resonator 41 so as to be electrically connected directly to the fourth quarter wavelength resonator 41, thereby allowing a signal transmission to be established between the second signal-lead electrode and the second resonance section 2. The first resonance section 1 and the second resonance section 2 are electromagnetically coupled to each other, allowing a signal transmission to be established between the first signal-lead electrode and the second signal-lead electrode. Hence, the signal transmission between the two substrates, namely the first substrate 10 and the second substrate 20, is possible.

The back of the first substrate 10 is formed with a first shielding electrode 81. The front of the second substrate 20 is formed with a second shielding electrode 82. Each of the first shielding electrode 81 and the second shielding electrode 82 has a ground potential as a whole. The first shielding electrode 81 serves to partially cover the first quarter wavelength resonator 11. The first shielding electrode 81 also has a function as a third shielding electrode which serves to partially cover the third quarter wavelength resonator 31. The first shielding electrode 81 is so provided as to cover at least the respective open ends of the first quarter wavelength resonator 11 and the third quarter wavelength resonator 31 between the first quarter wavelength resonator 11 and the second substrate 20, and between the third quarter wavelength resonator 31 and the second substrate 20. In particular, it is preferable that the first shielding electrode 81 be so provided as to wholly cover the wide conductor section 11A of the open end in the first quarter wavelength resonator 11 and the wide conductor section 31A of the open end in the third quarter wavelength resonator 31.

The second shielding electrode 82 serves to partially cover the second quarter wavelength resonator 21. The second shielding electrode 82 also has a function as a fourth shielding electrode which serves to partially cover the fourth quarter wavelength resonator 41. The second shielding electrode 82 is so provided as to cover at least the respective open ends of the second quarter wavelength resonator 21 and the fourth quarter wavelength resonator 41 between the second quarter wavelength resonator 21 and the first substrate 10, and between the fourth quarter wavelength resonator 41 and the first substrate 10. In particular, it is preferable that the second shielding electrode 82 be so provided as to wholly cover the wide conductor section 21A of the open end in the second quarter wavelength resonator 21 and the wide conductor section 41A of the open end in the fourth quarter wavelength resonator 41.

Between the first quarter wavelength resonator 11 of the first substrate 10 and the second substrate 20 is a first coupling window 81A provided for electromagnetically coupling the first quarter wavelength resonator 11 and the second quarter wavelength resonator 21 structuring the first resonance section 1. The first coupling window 81A also serves as a coupling window between the third quarter wavelength resonator 31 and the second substrate 20, for electromagnetically coupling the third quarter wavelength resonator 31 and the fourth quarter wavelength resonator 41 structuring the second resonance section 2. The first coupling window 81A is formed in a region in the first substrate 10 where the first shielding electrode 81 is not provided. More specifically, the first coupling window 81A is formed in a region corresponding at least to the respective short-circuit ends of the first quarter wavelength resonator 11 and the third quarter wavelength resonator 31.

Between the second quarter wavelength resonator 21 of the second substrate 20 and the first substrate 10 is a second coupling window 82A provided for electromagnetically coupling the first quarter wavelength resonator 11 and the second quarter wavelength resonator 21 structuring the first resonance section 1. The second coupling window 82A also serves as a coupling window between the fourth quarter wavelength resonator 41 and the first substrate 10, for electromagnetically coupling the third quarter wavelength resonator 31 and the fourth quarter wavelength resonator 41 structuring the second resonance section 2. The second coupling window 82A is formed in a region in the second substrate 20 where the second shielding electrode 82 is not provided. More specifically, the second coupling window 82A is formed in a region corresponding at least to the respective short-circuit ends of the second quarter wavelength resonator 21 and the fourth quarter wavelength resonator 41.

[Operation and Action]

In the signal transmission device according to the first embodiment, the first quarter wavelength resonator 11 in the first substrate 10 and the second quarter wavelength resonator 21 in the second substrate 20 are electromagnetically coupled based on the later-described hybrid resonance mode, by which the first resonance section 1 structures or works as a single coupled resonator which resonates at the predetermined first resonance frequency f1 (or at the second resonance frequency f2) as a whole. In addition thereto, in the state where the first substrate 10 and the second substrate 20 are sufficiently separated away from each other such that they do not electromagnetically coupled to each other (i.e., are separated far away from each other enough to fail to be electromagnetically coupled to each other), a resonance frequency derived from the first quarter wavelength resonator 11 in the first substrate 10 alone and a resonance frequency derived from the second quarter wavelength resonator 21 in the second substrate 20 alone are each a frequency (other frequency) f0 different from the predetermined first resonance frequency f1 (or different from the second resonance frequency f2).

Likewise, the third quarter wavelength resonator 31 in the first substrate 10 and the fourth quarter wavelength resonator 41 in the second substrate 20 are electromagnetically coupled based on the later-described hybrid resonance mode, by which the second resonance section 2 structures or works as a single coupled resonator which resonates at the predetermined first resonance frequency f1 (or at the second resonance frequency f2) as a whole. In addition thereto, in the state where the first substrate 10 and the second substrate 20 are sufficiently separated away from each other such that they do not electromagnetically coupled to each other (i.e., are separated far away from each other enough to fail to be electromagnetically coupled to each other), a resonance frequency derived from the third quarter wavelength resonator 31 in the first substrate 10 alone and a resonance frequency derived from the fourth quarter wavelength resonator 41 in the second substrate 20 alone are each other frequency f0 different from the predetermined first resonance frequency f1 (or different from the second resonance frequency f2).

Thus, a frequency characteristic in the state where the first substrate 10 and the second substrate 20 are so sufficiently separated away from each other that they are not electromagnetically coupled to each other, and a frequency characteristic in the state where the first substrate 10 and the second substrate 20 are electromagnetically coupled to each other, are different. Hence, when the first substrate 10 and the second substrate 20 are electromagnetically coupled to each other, the signal transmission is performed based on the first resonance frequency f1 (or based on the second resonance frequency f2), for example. On the other hand, when the first substrate 10 and the second substrate 20 are so sufficiently separated away from each other that they are not electromagnetically coupled to each other, the resonance is performed at sole other resonance frequency f0. Hence, the signal transmission is not performed based on the first resonance frequency f1 (or based on the second resonance frequency f2). Consequently, in the state where the first substrate 10 and the second substrate 20 are sufficiently separated away from each other, a signal having the same bandwidth as the first resonance frequency f1 (or the second resonance frequency f2) will be subjected to reflection even when that signal is inputted, thereby making it possible to prevent the leakage of signal (an electromagnetic wave) from the respective resonators 11, 21, 31, and 41.

[Principle of Signal Transmission Based on Hybrid Resonance Mode]

Figure 6:
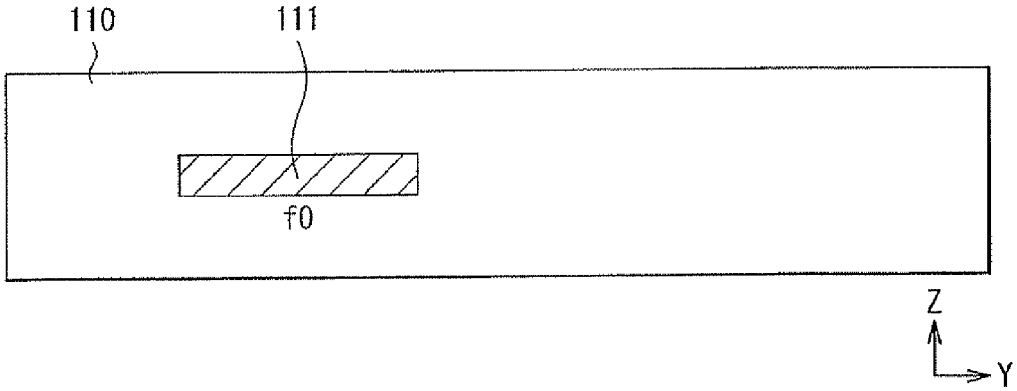
FIG. 6 is a cross-sectional view illustrating a substrate having a resonator structure according to a comparative example.

Description will now be made on a principle of the signal transmission based on the hybrid resonance mode mentioned above. For the purpose of convenience in description, a resonator structure according to a comparative example is contemplated here in which a single resonator 111 is formed in a first substrate 110 as illustrated in FIG. 6. The resonator structure according to this comparative example establishes a resonance mode in which the resonator 111 resonates at a single resonance frequency f0 as illustrated in (A) of FIG. 8. Also, an example is contemplated here in which a second substrate 120, having a configuration similar to that of the resonator structure according to the comparative example illustrated in FIG. 6, is disposed to oppose the first substrate 110 while providing the inter-substrate distance Da in between so as to be electromagnetically coupled to the first substrate 110. A single resonator 121 is formed in the second substrate 120. Since the resonator 121 in the second substrate 120 is the same in structure as the resonator 111 in the first substrate 110, the sole resonance mode is established in which the resonator 121 resonates at the single resonance frequency f0 as illustrated in (A) of FIG. 8 in a sole state where the second substrate 120 is not electromagnetically coupled to the first substrate 110. On the other hand, in a state where the two resonators 111 and 121 illustrated in FIG. 7 are electromagnetically coupled to each other, the resonators 111 and 121 form a first resonance mode having the first resonance frequency f1 which is lower than the sole resonance frequency f0 and a second resonance mode having the second resonance frequency f2 which is higher than the sole resonance frequency f0 to resonate due to a propagation effect of an electric wave, rather than resonating at the sole resonance frequency f0.

Figure 7:
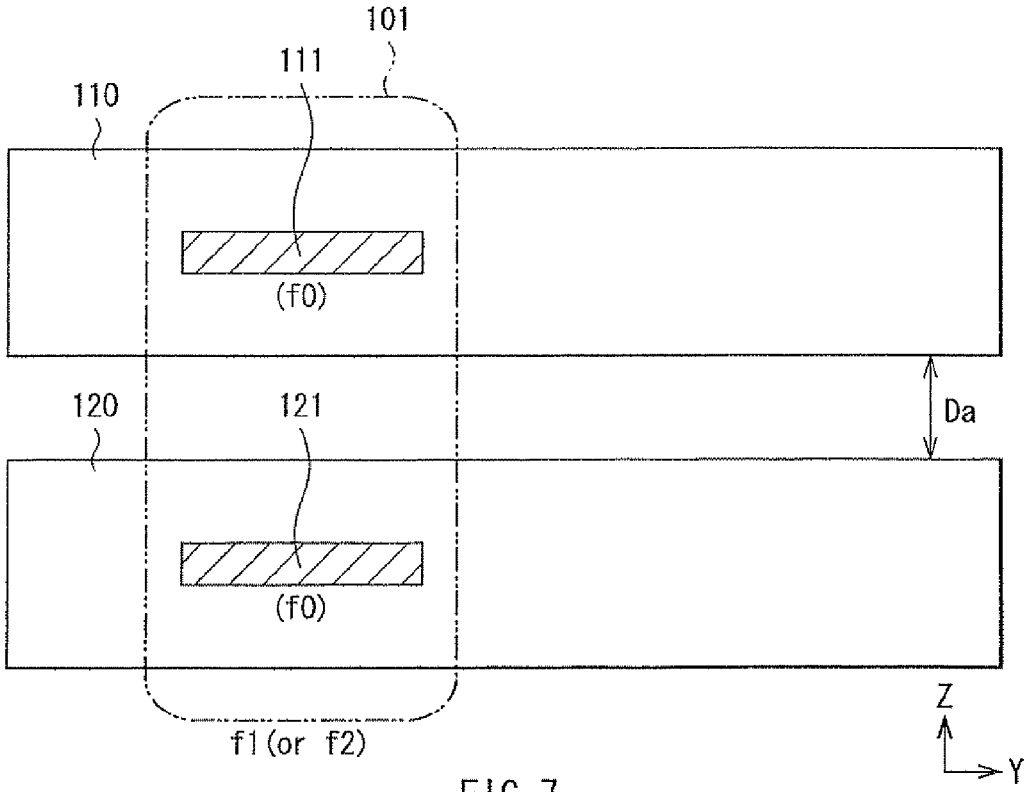
FIG. 7 is a cross-sectional view illustrating a configuration in which two substrates, each of which is the substrate illustrated in FIG. 6, are disposed to oppose each other.

When the two resonators 111 and 121 illustrated in FIG. 7, which are electromagnetically coupled to each other based on the hybrid resonance mode, are seen as a whole as a single coupled resonator 101, a resonator structure similar thereto may be arranged in a side-by-side fashion to structure a filter illustrated in FIG. 10 in which the first resonance frequency f1 (or the second resonance frequency f2) is a pass band. The signal transmission is possible by inputting a signal at a frequency near the first resonance frequency f1 (or the second resonance frequency f2). The signal transmission device according to the first embodiment illustrated in FIGS. 1 to 4 employs the configuration based on the principle described above.

In light of the principle discussed above, description will now be given in detail on a resonance mode in the signal transmission device according to the first embodiment. The frequency characteristic in the state where the first substrate 10 and the second substrate 20 are so sufficiently separated away from each other that they are not electromagnetically coupled to each other, and the frequency characteristic in the state where the first substrate 10 and the second substrate 20 are electromagnetically coupled to each other through the element such as the air layer, are different even when the first resonance section 1 and the second resonance section 2 are disposed side-by-side as in the signal transmission device illustrated in FIG. 1. Hence, when the first substrate 10 and the second substrate 20 are electromagnetically coupled to each other, the signal transmission is performed at the frequency of the pass band which includes the first resonance frequency f1 (or the second resonance frequency f2), for example. On the other hand, when the first substrate 10 and the second substrate 20 are so sufficiently separated away from each other that they are not electromagnetically coupled to each other, the resonance is performed at the frequency of the pass band including the sole other resonance frequency f0 which is different from the frequency at which the signal transmission is to be performed. Hence, the signal transmission is not performed based on the first resonance frequency f1 (or based on the second resonance frequency f2). Consequently, in the state where the first substrate 10 and the second substrate 20 are sufficiently separated away from each other, a signal having the same bandwidth as the first resonance frequency f1 (or the second resonance frequency 12) will be subjected to reflection even when that signal is inputted, thereby making it possible to prevent the leakage of signal (an electromagnetic wave) from the respective resonators 11, 21, 31, and 41.

Figure 5:
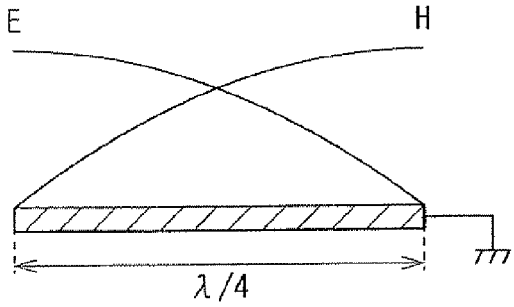
FIG. 5 describes an electric field intensity distribution and a magnetic field intensity distribution in a quarter wavelength resonator.

Incidentally, an electric field intensity distribution "E" and a magnetic field intensity distribution "H" in resonance of a typical quarter wavelength resonator having a uniform line width distribute to form sine waves whose phases are different from each other by 180 degrees, as illustrated in FIG. 5. Thus, an electric field energy is larger in an open end than in a short-circuit end thereof, whereas a magnetic field energy is larger in the short-circuit end than in the open end thereof. In particular, most of the electric field energy concentrates on a region from the center to the open end of the quarter wavelength resonator, whereas most of the magnetic field energy concentrates on a region from the center to the short-circuit end thereof. In the step-impedance resonator having the wider line width on the open end side as in each of the quarter wavelength resonators 11, 21, 31, and 41 according to the first embodiment, the electric field energy concentrates particularly on the wide conductor sections 11A, 21A, 31A, and 41A.

FIG. 3 illustrates an electric charge distribution, the electric field vector "E", and the current vector "i" in the first resonance mode (the resonance frequency f1) described above. In the first resonance mode, plus (+) charges concentrate on the open end and a current flows from the short-circuit end to the open end in each of the quarter wavelength resonators 11, 21, 31, and 41, as illustrated in FIG. 3. Here, since the first shielding electrode 81 is so provided in the first substrate 10 as to oppose the respective open ends of the first quarter wavelength resonator 11 and the third quarter wavelength resonator 31, minus (−) charges distribute on the first shielding electrode 81. Thus, in the first substrate 10, an electric field is generated toward the first shielding electrode 81 from each of the open ends of the first quarter wavelength resonator 11 and the third quarter wavelength resonator 31. As described above, in the quarter wavelength resonator, the electric field energy concentrates on the open end. Hence, the electric field is generated largely between the respective open ends of the first and the third quarter wavelength resonators 11 and 31 and the first shielding electrode 81. Likewise, since the second shielding electrode 82 is so provided in the second substrate 20 as to oppose the respective open ends of the second quarter wavelength resonator 21 and the fourth quarter wavelength resonator 41, the minus (−) charges distribute on the second shielding electrode 82. Thus, in the second substrate 20, the electric field is generated toward the second shielding electrode 82 from each of the open ends of the second quarter wavelength resonator 21 and the fourth quarter wavelength resonator 41. Since the electric field energy concentrates on the open end in the quarter wavelength resonator as described above, the electric field is generated largely between the respective open ends of the second and the fourth quarter wavelength resonators 21 and 41 and the second shielding electrode 82.

In accordance with the scheme described above, the open end, on which the electric field energy concentrates at the time of the resonance, of the first quarter wavelength resonator 11 is covered with the first shielding electrode 81. Thereby, the electric field distribution that generates from the first quarter wavelength resonator 11 toward the second substrate 20 reduces significantly across the first shielding electrode 81 (i.e., the electric field intensity of the electric field generated from the first quarter wavelength resonator 11 toward the second substrate 20 decreases in the first shielding electrode 81 as a boundary). Similarly, the open end, on which the electric field energy concentrates at the time of the resonance, of the second quarter wavelength resonator 21 is also covered with the second shielding electrode 82. Thereby, the electric field distribution that generates from the second quarter wavelength resonator 21 toward the first substrate 10 reduces significantly across the second shielding electrode 82 (i.e., the electric field intensity of the electric field generated from the second quarter wavelength resonator 21 toward the first substrate 10 decreases in the second shielding electrode 82 as a boundary). Thus, the optimization of sizes of the shielding electrodes allows the first quarter wavelength resonator 11 and the second quarter wavelength resonator 21 structuring the first resonance section 1 to be placed in a state of an electromagnetic coupling primarily involving a magnetic field component (a magnetic field coupling). The electric field distribution is thus reduced significantly in an element such as, but not limited to, the air layer between the first substrate 10 and the second substrate 20 in the first resonance section 1, thereby making it possible to suppress a variation in a resonance frequency in the first resonance section 1 even when a variation is occurred in the inter-substrate distance Da of the element such as, but not limited to, the air layer between the first substrate 10 and the second substrate 20. In other words, a variation due to a change in a thickness of the element such as, but not limited to, the air layer is suppressed in an effective relative dielectric constant between the first substrate 10 and the second substrate 20 and between the first quarter wavelength resonator 11 of the first substrate 10 and the second quarter wavelength resonator 21 of the second substrate 20.

Likewise, the open end, on which the electric field energy concentrates at the time of the resonance, of the third quarter wavelength resonator 31 is covered with the first shielding electrode 81. Thereby, the electric field distribution that generates from the third quarter wavelength resonator 31 toward the second substrate 20 reduces significantly across the first shielding electrode 81 (i.e., the electric field intensity of the electric field generated from the third quarter wavelength resonator 31 toward the second substrate 20 decreases in the first shielding electrode 81 as a boundary). Similarly, the open end, on which the electric field energy concentrates at the time of the resonance, of the fourth quarter wavelength resonator 41 is also covered with the second shielding electrode 82. Thereby, the electric field distribution that generates from the fourth quarter wavelength resonator 41 toward the first substrate 10 reduces significantly across the second shielding electrode 82 (i.e., the electric field intensity of the electric field generated from the fourth quarter wavelength resonator 41 toward the first substrate 10 decreases in the second shielding electrode 82 as a boundary). Thus, the optimization of sizes of the shielding electrodes allows the third quarter wavelength resonator 31 and the fourth quarter wavelength resonator 41 structuring the second resonance section 2 to be placed in the state of the electromagnetic coupling primarily involving the magnetic field component (the magnetic field coupling). The electric field distribution is thus reduced significantly in an element such as, but not limited to, the air layer between the first substrate 10 and the second substrate 20 in the second resonance section 2, thereby making it possible to suppress a variation in a resonance frequency in the second resonance section 2 even when the variation is occurred in the inter-substrate distance Da of the element such as, but not limited to, the air layer between the first substrate 10 and the second substrate 20. Hence, it is possible to suppress a variation in factors such as a pass frequency and a pass band caused by the variation in the inter-substrate distance Da. In other words, the variation due to the change in the thickness of the element such as, but not limited to, the air layer is suppressed in the effective relative dielectric constant between the first substrate 10 and the second substrate 20 and between the third quarter wavelength resonator 31 of the first substrate 10 and the fourth quarter wavelength resonator 41 of the second substrate 20.

[Specific Design Example and Characteristics Thereof]

A specific design example of the signal transmission device according to the first embodiment and its characteristics will now be described in comparison to characteristics of a resonator structure according to a comparative example. FIG. 9 illustrates the specific design example of the resonator structure 201 according to the comparative example. FIG. 10 represents a resonance frequency characteristic of the resonator structure 201 illustrated in FIG. 9. In the resonator structure 201 according to the comparative example, the back of the first substrate 10 is formed with the first quarter wavelength resonator 11, and the front of the second substrate 20 is formed with the second quarter wavelength resonator 21. Also, the front of the first substrate 10 and the back of the second substrate 20 are provided with a ground electrode 91 and a ground electrode 92 each serving as a ground layer, respectively. The first quarter wavelength resonator 11 and the second quarter wavelength resonator 21 are so disposed that respective open ends thereof are opposed to each other and respective short-circuit ends thereof are opposed to each other with an air layer in between, and are interdigitally coupled to each other.

In the resonator structure 201 according to the comparative example illustrated in FIG. 9, each of the first substrate 10 and the second substrate 20 has a size as viewed from the top (hereinafter simply referred to as a "planar size") of two millimeters square, a substrate thickness of 100 micrometers, and a relative dielectric constant of 3.85. The first quarter wavelength resonator 11 and the second quarter wavelength resonator 21 are each configured of an electrode pattern having a uniform line width. A planar size of each of the first quarter wavelength resonator 11 and the second quarter wavelength resonator 21 has a length in the X-direction of 1.5 mm and a length in the Y-direction (i.e., a width) of 0.2 mm. FIG. 10 represents a result of calculation of a resonance frequency when a thickness of the air layer between the substrates (i.e., the inter-substrate distance Da) is varied from 10 micrometers to 100 micrometers in this configuration. As can be seen from FIG. 10, the resonance frequency varies up to about 70 percent with the variation in the thickness of the air layer in the resonator structure 201 according to the comparative example. One reason is that an effective relative dielectric constant varies between the first substrate 10 and the second substrate 20 due to the change in the thickness of the air layer.

FIGS. 11 to 13 illustrate the specific design example of the first resonance section 1 of the signal transmission device according to the first embodiment. FIG. 14 represents a resonance frequency characteristic of the design example illustrated in FIGS. 11 to 13. This design example employs similar design values to those of the resonator structure 201 according to the comparative example illustrated in FIG. 9 for the planar size and the substrate thickness of each of the first substrate 10 and the second substrate 20. A relative dielectric constant of each of the first substrate 10 and the second substrate 20 is 3.5. As illustrated in FIG. 13, a planar size of each of the first shielding electrode 81 and the second shielding electrode 82 has a length in the X-direction of 1.1 mm and a length in the Y-direction (i.e., a width) of 2 mm. A planar size with respect to the short-circuit end of each of the first quarter wavelength resonator 11 and the second quarter wavelength resonator 21 has a length in the X-direction of 1.0 mm and a length in the Y-direction (a width) of 0.15 mm, whereas a planar size with respect to the open end of each of the first quarter wavelength resonator 11 and the second quarter wavelength resonator 21 has a length in the X-direction of 0.5 mm and a length in the Y-direction (a width) of 0.4 mm. FIG. 14 represents a result of calculation of a resonance frequency when the thickness of the air layer between the substrates (i.e., the inter-substrate distance Da) is varied from 10 micrometers to 100 micrometers in this configuration. In the resonator structure according to the first embodiment, as can be seen from FIG. 14, a change in the resonance frequency is small, and the resonance frequency varies only up to about 4 percent with the variation in the thickness of the air layer. It is to be noted that, in the characteristic graph of FIG. 14, a value of the resonance frequency fluctuates up and down with the variation in the inter-substrate distance Da, as if the graph is a polygonal line graph. This is due to an error in calculation, and in fact the resonance frequency increases gradually with the increase in the inter-substrate distance Da to form a gently curved graph.

FIG. 15 describes an electric field intensity distribution between the first substrate 10 and the second substrate 20 according to the design example illustrated in FIGS. 11 to 13. As can be seen from FIG. 15, there is hardly any electric field between the first substrate 10 and the second substrate 20. One reason is that, as mentioned above, the open end of the first quarter wavelength resonator 11 and the open end of the second quarter wavelength resonator 21 are covered with the first shielding electrode 81 and the second shielding electrode 82, respectively, between the first substrate 10 and the second substrate 20. The short-circuit end of the first quarter wavelength resonator 11 and the short-circuit end of the second quarter wavelength resonator 21 are not covered with the first shielding electrode 81 and the second shielding electrode 82, so that there is hardly any electric field component between the first substrate 10 and the second substrate 20 on the short-circuit end side, and a magnetic field component serves as a primary component therebetween. It is to be noted that FIG. 15 represents the electric field distribution based on the first resonance mode in the hybrid resonance mode discussed above.

FIGS. 16 to 19 illustrate a design example of a filter to which the resonator structure of the signal transmission device according to the first embodiment is applied. FIG. 17A illustrates a configuration of the front of the first substrate 10 in the filter illustrated in FIG. 16, and FIG. 17B illustrates a configuration of the back of the first substrate 10. FIG. 18A illustrates a configuration of the front of the second substrate 20 in the filter illustrated in FIG. 16, and FIG. 18B illustrates a configuration of the back of the second substrate 20. FIG. 19 illustrates specific design values of resonator sections in the filter illustrated in FIG. 16.

The basic configuration of the resonator sections according to the filter are similar to those according to the signal transmission device illustrated in FIGS. 1 to 4. Namely, the front of the first substrate 10 is formed with the first quarter wavelength resonator 11 and the third quarter wavelength resonator 31 which are provided in a side-by-side fashion. The back of the second substrate 20 is formed with the second quarter wavelength resonator 21 and the fourth quarter wavelength resonator 41 which are provided in a side-by-side fashion. The quarter wavelength resonators 11, 21, 31, and 41 structure step-impedance resonators (SIR) having the wide conductor sections 11A, 21A, 31A, and 41A in the open ends thereof, respectively. Also, the back of the first substrate 10 is formed with the first shielding electrode 81, and the front of the second substrate 20 is formed with the second shielding electrode 82. The first coupling window 81A is formed on the back of the first substrate 10 in a position corresponding at least to the respective short-circuit ends of the first quarter wavelength resonator 11 and the third quarter wavelength resonator 31. The second coupling window 82A is formed on the front of the second substrate 20 in a position corresponding at least to the respective short-circuit ends of the second quarter wavelength resonator 21 and the fourth quarter wavelength resonator 41.

The front of the first substrate 10 is formed with a first conductor line 71 having a coplanar line configuration. As illustrated in FIG. 17A, the first conductor line 71 is physically and directly connected to the first quarter wavelength resonator 11 in a region nearer to the short-circuit end than the wide conductor section 11A so as to be electrically connected directly to the first quarter wavelength resonator 11, thereby structuring the first signal-lead electrode used for a first resonance section 1A. Also, around each of the first conductor line 71, the first quarter wavelength resonator 11, and the third quarter wavelength resonator 31 is provided through-holes 73 that penetrate the front and the back of the first substrate 10 and allow the front and the back to be electrically connected mutually.

The back of the first substrate 20 is formed with a second conductor line 72 having a coplanar line configuration. As illustrated in FIG. 18B, the second conductor line 72 is physically and directly connected to the fourth quarter wavelength resonator 41 in a region nearer to the short-circuit end than the wide conductor section 41A so as to be electrically connected directly to the fourth quarter wavelength resonator 41, thereby structuring the second signal-lead electrode used for a second resonance section 2A. Also, around each of the second conductor line 72, the second quarter wavelength resonator 21, and the fourth quarter wavelength resonator 41 is provided through-holes 74 that penetrate the front and the back of the second substrate 20 and allow the front and the back to be electrically connected mutually.

In the filter according to this embodiment, a signal is inputted from the first conductor line 71 (the first signal-lead electrode) formed on the front of the first substrate 10, and the signal is outputted through the first resonance section 1A and the second resonance section 2A from the second conductor line 72 (the second signal-lead electrode) formed on the back of the second substrate 20, for example. FIG. 20 represents a result of calculation of a resonance frequency when the thickness of the air layer between the substrates (i.e., the inter-substrate distance Da) is varied from 50 micrometers to 100 micrometers and to 150 micrometers in this configuration, and indicates a pass characteristic and a reflection characteristic as a filter. It can be seen from FIG. 20 that the pass characteristic as the filter is hardly influenced by the variation in the inter-substrate distance Da.

[Effect]

The signal transmission device according to the first embodiment has the resonator structure in which the region in the open end, on which the electric field energy concentrates in resonance, of the resonators provided in the first substrate 10 is covered with the first shielding electrode 81, and in which the region in the open end, on which the electric field energy concentrates in resonance, of the resonators provided in the second substrate 20 is covered with the second shielding electrode 82. Thus, the optimization of sizes of the shielding electrodes allows the electromagnetic coupling primarily involving the magnetic field component to be established between the first substrate 10 and the second substrate 20, making it possible to significantly reduce the electric field distribution in an element such as, but not limited to, the air layer. Thereby, it is possible to suppress a variation in a resonance frequency in the first resonance section 1 and in the second resonance section 2 even when a variation is occurred in the inter-substrate distance Da of the element such as, but not limited to, the air layer between the first substrate 10 and the second substrate 20. Hence, it is possible to suppress the variation in factors such as the pass frequency and the pass band caused by the variation in the inter-substrate distance Da.

Second Embodiment

Hereinafter, a signal transmission device according to a second embodiment of the technology will be described. Note that the same or equivalent elements as those of the signal transmission device according to the first embodiment described above are denoted with the same reference numerals, and will not be described in detail.

The first embodiment described above has the resonator structure including the two substrates, namely the first substrate 10 and the second substrate 20. Alternatively, a multilayer structure may be employed in which three or more substrates are disposed in an opposed fashion. FIG. 21 illustrates an exemplary configuration in which n-number of substrates (where "n" is an integer equal to or more than three) are disposed to oppose one another with the inter-substrate distance Da in between. In the second embodiment having the multilayer structure, only one side (the back) of a first substrate 10-1 serving as an uppermost layer may be formed with a first shielding electrode 81-1. Also, only one side (the front) of an n-th substrate **10-*n* serving as a lowermost layer may be formed with an n-th shielding electrode 81-*n*. A second substrate 10-2 to an n−1 th substrate 10-*n*−1 serving as intermediate layers are formed with second shielding electrodes 81-2 to n−1 th shielding electrodes 81-*n*−1, respectively, on both sides (the front and the back) thereof. Thus, between the first substrate 10-1 and the second substrate 10-2, an open end of a first quarter wavelength resonator 11-1 is covered with the first shielding electrode 81-1, and an open end of a second quarter wavelength resonator 11-2 is covered with the second shielding electrodes 81-2. Thereby, the first quarter wavelength resonator 11-1 and the second quarter wavelength resonator 11-2 between the first substrate 10-1 and the second substrate 10-2 are placed in the state of the electromagnetic coupling primarily involving the magnetic field component (the magnetic field coupling) through coupling windows 81A-1 and 81A-2. Hence, it is possible to suppress a variation in a resonance frequency even when a variation is occurred in the inter-substrate distance Da of the element such as, but not limited to, the air layer between the first substrate 10-1 and the second substrate 10-2. Likewise, the electromagnetic coupling primarily involving the magnetic field component (the magnetic field coupling) is established between each of the substrates from the second substrate 10-2 to the n-th substrate 10-*n***, thereby making it possible o suppress a variation in a resonance frequency even when a variation is occurred in the inter-substrate distance Da of the element such as, but not limited to, the air layer between each of those substrates.

In the multilayer structure according to the second embodiment, the first quarter wavelength resonator 11-1 to the n-th quarter wavelength resonator **11-*n* likewise structure a single coupled resonator as a whole, and resonate at the hybrid resonance mode having the plurality of resonance modes. Also, in the resonance mode having the lowest resonance frequency f1 in the plurality of resonance modes, the currents flowing in the respective quarter wavelength resonators between each of the substrates become the same, as in the embodiment illustrated in FIG. 3**. Further, the frequency characteristic in the state where the respective substrates are so sufficiently separated away from one other that they are not electromagnetically coupled to one other, and the frequency characteristic in the state where the respective substrates are electromagnetically coupled to one other through the element such as, but not limited to, the air layer, are different.

Third Embodiment

Hereinafter, a signal transmission device according to a third embodiment of the technology will be described. Note that the same or equivalent elements as those of the signal transmission device according to the first or the second embodiment described above are denoted with the same reference numerals, and will not be described in detail.

In the first embodiment described above, the first quarter wavelength resonator 11 and the second quarter wavelength resonator 21 (or the third quarter wavelength resonator 31 and the fourth quarter wavelength resonator 41) are so disposed that the respective open ends thereof are opposed to each other and the respective short-circuit ends thereof are opposed to each other. Alternatively, the first quarter wavelength resonator 11 and the second quarter wavelength resonator 21 may be so disposed as to establish an interdigital coupling. The interdigital coupling as used herein refers to a coupling scheme in which two resonators, each having a first end serving as a short-circuit end and a second end serving as an open end, are so disposed that the open end of the first resonator and the short-circuit end of the second resonator are opposed to each other and that the short-circuit end of the first resonator and the open end of the second resonator are opposed to each other, so as to allow those two resonators to be electromagnetically coupled to each other.

FIG. 22 illustrates an example of an interdigital resonator structure. The first substrate 10-1 is formed with the first quarter wavelength resonator 11-1, and has an open end provided on a region of the first substrate 10-1 opposed to the second substrate 10-2 and covered with the first shielding electrode 81-1. The second substrate 10-2 is formed with the second quarter wavelength resonator 11-2, and has an open end provided on a region of the second substrate 10-2 opposed to the first substrate 10-1 and covered with the second shielding electrode 81-2. The first quarter wavelength resonator 11-1 and the second quarter wavelength resonator 11-2 are interdigitally coupled between the first substrate 10-1 and the second substrate 10-2 through the coupling windows 81A-1 and the 81A-2. The interdigital coupling establishes the state of the electromagnetic coupling which primarily involves the magnetic field component (the magnetic field coupling). In the interdigital resonator structure according to the third embodiment, the first quarter wavelength resonator 11-1 and the second quarter wavelength resonator 11-2 likewise structure a single coupled resonator as a whole, and resonate at the hybrid resonance mode having the plurality of resonance modes. Also, in the resonance mode having the lowest resonance frequency f1 in the plurality of resonance modes, the currents flowing in the respective quarter wavelength resonators between the substrates become the same. Further, the frequency characteristic in the state where the respective substrates are so sufficiently separated away from one other that they are not electromagnetically coupled to one other, and the frequency characteristic in the state where the respective substrates are electromagnetically coupled to one other through the element such as, but not limited to, the air layer, are different.

Also, the interdigital resonator structure according to the third embodiment may be combined with the multilayer structure according to the second embodiment illustrated in FIG. 21.

Fourth Embodiment

Hereinafter, a signal transmission device according to a fourth embodiment of the technology will be described. Note that the same or equivalent elements as those of the signal transmission devices according to the first to the third embodiments described above are denoted with the same reference numerals, and will not be described in detail.

The first embodiment described above has the resonator structure which utilizes the quarter wavelength resonators. Alternatively, a resonator structure may be employed which uses half wavelength resonators. For example, FIG. 23 illustrates an electric field intensity distribution "E" and a magnetic field intensity distribution "H" in resonance of a typical half wavelength resonator of a both-end-open type having a uniform line width. In the both-end-open type half wavelength resonator, an electric field energy is larger in an open end than in a central portion which is equivalent to a short-circuit end, whereas a magnetic field energy is larger in the central portion equivalent to the short-circuit end than in the open end thereof. Thus, when configuring a resonator structure in which the half wavelength resonators are opposed to each other, the open ends at the both ends may be covered with the shielding electrodes 80A and 80B, respectively, as illustrated in FIG. 24 to allow the electric field component to be reduced. FIG. 24 illustrates an example of a half wavelength resonator 60 of a step-impedance type having a line width which is wider in the open ends than in the central portion. The half wavelength resonator 60 is formed with wide electrode parts 60A and 60B at both ends thereof. In the step-impedance half wavelength resonator 60 having the configuration described above, the electric field energy concentrates particularly on the wide electrode parts 60A and 60B as in the quarter wavelength resonators. Thus, the wide electrode parts 60A and 60B at the both ends may be covered with the shielding electrodes 80A and 80B, respectively, and the central portion may be formed with a coupling window 80C.

FIG. 25 illustrates an example of a resonator structure in which two both-end-open type half wavelength resonators are used. In this configuration example, the first substrate 10-1 is formed with a first half wavelength resonator 60-1, and both ends (open ends) thereof are covered with first shielding electrodes 80A-1 and 80B-1, respectively, in a region of the first substrate 10-1 opposed to the second substrate 10-2. The second substrate 10-2 is formed with a second half wavelength resonator 60-2, and both ends (open ends) thereof are covered with second shielding electrodes 80A-2 and 80B-2, respectively, in a region of the second substrate 10-2 opposed to the first substrate 10-1. The first half wavelength resonator 60-1 and the second half wavelength resonator 60-2 are coupled, between the first substrate 10-1 and the second substrate 10-2 through the coupling windows 81C-1 and the 81C-2 in the center, to each other through the electromagnetic coupling primarily involving the magnetic field component (the magnetic field coupling). In the resonator structure according to the fourth embodiment, the first half wavelength resonator 60-1 and the second half wavelength resonator 60-2 likewise structure a single coupled resonator as a whole, and resonate at the hybrid resonance mode having the plurality of resonance modes. Also, in the resonance mode having the lowest resonance frequency f1 in the plurality of resonance modes, the currents flowing in the respective half wavelength resonators between the substrates become the same in the same opposed positions thereof. Further, the frequency characteristic in the state where the respective substrates are so sufficiently separated away from one other that they are not electromagnetically coupled to one other, and the frequency characteristic in the state where the respective substrates are electromagnetically coupled to one other through the element such as, but not limited to, the air layer, are different.

Fifth Embodiment

Hereinafter, a signal transmission device according to a fifth embodiment of the technology will be described. Note that the same or equivalent elements as those of the signal transmission devices according to the first to the fourth embodiments described above are denoted with the same reference numerals, and will not be described in detail.

The fourth embodiment described above has the resonator structure in which the both-end-open type half wavelength resonators are provided for the two substrates. Alternatively, a multilayer structure may be employed in which three or more substrates are disposed in an opposed fashion as in the embodiments (for example, the embodiment illustrated in FIG. 21) in which the quarter wavelength resonators are used. FIG. 26 illustrates an exemplary configuration in which n-number of substrates (where "n" is an integer equal to or more than three) are disposed to oppose one another with the inter-substrate distance Da in between. In the fifth embodiment having the multilayer structure, only one side (the back) of the first substrate 10-1 serving as an uppermost layer may be formed with the first shielding electrodes 80A-1 and 80B-1. Also, only one side (the front) of the n-th substrate **10-*n* serving as a lowermost layer may be formed with n-th shielding electrodes 80A-n and 80B-n. The second substrate 10-2 to the n−1 th substrate 10-*n*−1 serving as intermediate layers are formed with second shielding electrodes 80A-2 and 80B-2 to n−1 th shielding electrodes 80A-n−1 and 80B-n−1, respectively, on both sides (the front and the back) thereof. Thus, between the first substrate 10-1 and the second substrate 10-2, both ends (open ends) of a first half wavelength resonator 60-1 is covered with the first shielding electrodes 80A-1 and 80B-1, and both ends (open ends) of a second half wavelength resonator 60-2 is covered with the second shielding electrodes 80A-1 and 80B-2. Thereby, the first half wavelength resonator 60-1 and the second half wavelength resonator 60-2 between the first substrate 10-1 and the second substrate 10-2 are placed in the state of the electromagnetic coupling primarily involving the magnetic field component (the magnetic field coupling) through the coupling windows 81C-1 and 81C-2 in the center. Hence, it is possible to suppress a variation in a resonance frequency even when a variation is occurred in the inter-substrate distance Da of the element such as, but not limited to, the air layer between the first substrate 10-1 and the second substrate 10-2. Likewise, the electromagnetic coupling primarily involving the magnetic field component (the magnetic field coupling) is established between each of the substrates from the second substrate 10-2 to the n-th substrate 10-*n***, thereby making it possible to suppress a variation in a resonance frequency even when a variation is occurred in the inter-substrate distance Da of the element such as, but not limited to, the air layer between each of those substrates.

In the multilayer structure according to the fifth embodiment, the first half wavelength resonator 60-1 to the n-th half wavelength resonator **60-*n* likewise structure a single coupled resonator as a whole, and resonate at the hybrid resonance mode having the plurality of resonance modes. Also, in the resonance mode having the lowest resonance frequency f1** in the plurality of resonance modes, the currents flowing in the respective half wavelength resonators between each of the substrates become the same in the same opposed positions thereof. Further, the frequency characteristic in the state where the respective substrates are so sufficiently separated away from one other that they are not electromagnetically coupled to one other, and the frequency characteristic in the state where the respective substrates are electromagnetically coupled to one other through the element such as, but not limited to, the air layer, are different.

Sixth Embodiment

Hereinafter, a signal transmission device according to a sixth embodiment of the technology will be described. Note that the same or equivalent elements as those of the signal transmission devices according to the first to the fifth embodiments described above are denoted with the same reference numerals, and will not be described in detail.

Each of the embodiments described above has the configuration in which only a dielectric layer derived from the substrate is provided between the resonator and the shielding electrode formed in each of the substrates. Alternatively, a capacitor electrode may be provided between the resonator and the shielding electrode particularly on the open end side. This allows the electric field energy to be concentrated more on the open end side, and allows the electric field component between the substrates to be further reduced by covering the portion on which the electric field energy is concentrated with the shielding electrode. It is also possible to achieve miniaturization directed to the resonator.

FIG. 27 illustrates an embodiment where a capacitor electrode 91 is provided between the first quarter wavelength resonator 11-1 and the first shielding electrode 81-1 in the first substrate 10-1 of the multilayer structure illustrated in FIG. 21 in which the quarter wavelength resonators are used, for example. The capacitor electrode 91 is electrically connected to the open end of the first quarter wavelength resonator 11-1 through a contact hole 92. The capacitor electrode may be provided likewise for other substrates from the second substrate 10-2 to the n-th substrate **10-*n***.

FIG. 28 illustrates another embodiment where capacitor electrodes 91A and 91B are provided between the both ends of the first half wavelength resonator 60-1 and the first shielding electrodes 80A-1 and 80B-1 in the first substrate 10-1 of the multilayer structure illustrated in FIG. 26 in which the half wavelength resonators are used, for example. The capacitor electrodes 91A and 91B are electrically connected to the both ends (the open ends) of the first half wavelength resonator 60-1 through contact holes 92A and 92B, respectively. The capacitor electrodes may be provided likewise for other substrates from the second substrate 10-2 to the n-th substrate **10-*n***.

Seventh Embodiment

Hereinafter, a signal transmission device according to a seventh embodiment of the technology will be described. Note that the same or equivalent elements as those of the signal transmission devices according to the first to the sixth embodiments described above are denoted with the same reference numerals, and will not be described in detail.

The first embodiment described above describes the quarter wavelength resonator of the step-impedance type having the two-staged line widths in which the line width is narrower in the short-circuit end and the line width is wider in the open end as illustrated in FIG. 2, although a shape of the quarter wavelength resonator is not limited to that illustrated in FIG. 2. In one embodiment, a line width may be widened in a curved manner as approaching the open end from the short-circuit end, such as that of a quarter wavelength resonator 50 illustrated in FIG. 29. It is preferable also in this embodiment that a region from the open end to a central portion of the line be covered with the shielding electrode 51. A shape of the half wavelength resonator in the embodiment which utilizes the half wavelength resonator is also not limited to that illustrated in FIG. 24, and various shapes may be employed therefor.

Eighth Embodiment

Hereinafter, a signal transmission device according to a seventh embodiment of the technology will be described. Note that the same or equivalent elements as those of the signal transmission devices according to the first to the seventh embodiments described above are denoted with the same reference numerals, and will not be described in detail.

FIG. 30 illustrates a cross-sectional configuration of the signal transmission device according to the eighth embodiment of the technology. In the signal transmission device according to the first embodiment described above, the first signal-lead electrode used for inputting and outputting a signal is physically and directly connected to the first quarter wavelength resonator 11 formed on the first substrate 10 so as to be electrically connected directly to the first quarter wavelength resonator 11, for example. In the eighth embodiment, a first signal-lead electrode 53 may be provided which is so disposed as to have a spacing relative to the first quarter wavelength resonator 11, as illustrated in FIG. 30. The first signal-lead electrode 53 here is structured by a resonator which resonates at the similar resonance frequency f1 as the resonance frequency f1 of the first resonance section 1, by which the first signal-lead electrode 53 and the first resonance section 1 are electromagnetically coupled at the resonance frequency f1.

Likewise, although the second signal-lead electrode used for inputting and outputting a signal is physically and directly connected to the fourth quarter wavelength resonator 41 formed on the second substrate 20 so as to be electrically connected directly to the fourth quarter wavelength resonator 41, for example, a second signal-lead electrode 54 may be provided which is so disposed as to have a spacing relative to the fourth quarter wavelength resonator 41, as illustrated in FIG. 30. The second signal-lead electrode 54 here is structured by a resonator which resonates at the similar resonance frequency f1 as the resonance frequency f1 of the second resonance section 2, by which the second signal-lead electrode 54 and the second resonance section 2 are electromagnetically coupled at the resonance frequency f1

Other Embodiments

Although the technology has been described in the foregoing by way of example with reference to the embodiments, the technology is not limited thereto but may be modified in a wide variety of ways.

For example, in the first embodiment described above, the first resonance section 1 and the second resonance section 2 both have substantially the same resonator structure, although it is not limited thereto. Alternatively, for example, the second resonance section 2 may have a different resonator structure, as long as the configuration is established in which at least the open ends of the resonators formed between the respective substrates are covered with the shielding electrodes between the substrates.

Also, in the first embodiment described above, the two resonators, namely the first resonance section 1 and the second resonance section 2, are disposed in a side-by-side fashion, although it is not limited thereto. Alternatively, three or more resonance sections may be arranged in a side-by-side fashion.

Further, in the embodiments described above, the dielectric substrates are formed with the $\lambda/4$ wavelength resonators or the $\lambda/2$ wavelength resonators, although it is not limited thereto. Alternatively, other resonators such as a $3\lambda/4$ wavelength resonator and a $\lambda$ wavelength resonator may be employed, as long as the resonator is a line resonator having an open end and in which a resonance frequency of the resonator alone is f0.

In the first embodiment described above, the relative dielectric constant of the first substrate 10 and that of the second substrate 20 are made equal to each other, although it is not limited thereto. Alternatively, the relative dielectric constant of the first substrate 10 and that of the second substrate 20 may be different from each other, as long as a layer having a relative dielectric constant different from that of at least one of the first substrate 10 and the second substrate, 20 is sandwiched therebetween.

These alternative embodiments are also applicable to other embodiments such as the second to the eighth embodiments described above.

As used herein, the term "signal transmission device" refers not only to a signal transmission device for transmitting and receiving a signal such as an analog signal and a digital signal, but also refers to a signal transmission device used for transmitting and receiving electric power. The technique of the signal transmission device such as that disclosed in any one of the embodiments of the technology described above is applicable to any transmission technique such as, but not limited to, a non-contact power supply technique and a near-field wireless transmission technique.

Further, in the first embodiment described above, the first signal-lead electrode is formed on the first substrate 10 and the second signal-lead electrode is formed on the second substrate 20 to perform the signal transmission between the separate substrates, for example. Alternatively, the respective signal-lead electrodes may be formed on the same substrate to perform the signal transmission within the substrate. In one embodiment, the first signal-lead electrode may be formed on the back of the second substrate 20 and connected to the second quarter wavelength resonator 21 and the second signal-lead electrode may be formed on the back of the second substrate 20 and connected to the fourth quarter wavelength resonator 41 to perform the signal transmission within the second substrate 20. In this embodiment, a direction of transmission of a signal is within a plane of the second substrate 20, although the resonator on the first substrate 10 is utilized as well (i.e., the volume in a vertical direction is utilized) to transmit the signal. Hence, as compared with a case where only the electrode patterns on the second substrate 20 are used to perform the transmission, it is possible to prevent an increase in the area in a plane direction in a case where a particular frequency is selected as a filter to transmit a signal. Namely, it is possible to perform, as a filter, the signal transmission within the substrate while preventing the increase in the area in the plane direction.

The present disclosure contains subject matter related to that disclosed in Japanese Priority Patent Application JP 2010-211148 filed in the Japan Patent Office on Sep. 21, 2010, the entire content of which is hereby incorporated by reference.

Although the technology has been described in terms of exemplary embodiments, it is not limited thereto. It should be appreciated that variations may be made in the described embodiments by persons skilled in the art without departing from the scope of the technology as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. Moreover, no element or component in this disclosure is intended to be dedicated to the public regardless of whether the element or component is explicitly recited in the following claims.

What is claimed is:

1. A signal transmission device, comprising:

a first substrate and a second substrate which are disposed to oppose each other with a spacing in between;

a first resonance section including a first resonator and a second resonator which are electromagnetically coupled to each other, the first resonator being provided in a first region of the first substrate and having an open end, and the second resonator being provided in a region of the second substrate corresponding to the first region and having an open end;

a second resonance section disposed side-by-side relative to the first resonance section, and electromagnetically coupled to the first resonance section to perform a signal transmission between the first and second resonance sections; and a first shielding electrode and a second shielding electrode, the first shielding electrode being disposed between the first resonator and the second substrate and partially covering the first resonator to allow at least the open end of the first resonator to be covered therewith, and the second shielding electrode being disposed between the second resonator and the first substrate and partially covering the second resonator to allow at least the open end of the second resonator to be covered therewith.

2. The signal transmission device according to claim 1, wherein each of the first resonator and the second resonator is a line resonator having a first end serving as the open end and a second end serving as a short-circuit end, the open end having a line width wider than that in the short-circuit end, the first shielding electrode is provided to cover at least a wider line width region in the first resonator, and the second shielding electrode is provided to cover at least a wider line width region in the second resonator.

3. The signal transmission device according to claim 1, wherein each of the first resonator and the second resonator is a line resonator having a couple of ends each serving as the open end, each of the open ends having a line width wider than that of a central portion thereof, the first shielding electrode is provided to cover at least a wider line width region in the first resonator, and the second shielding electrode is provided to cover at least a wider line width region in the second resonator.

4. The signal transmission device according to claim 1, further comprising:

a first capacitor electrode electrically connected to the open end of the first resonator, and provided between the open end of the first resonator and the first shielding electrode; and a second capacitor electrode electrically connected to the open end of the second resonator, and provided between the open end of the second resonator and the second shielding electrode.

5. The signal transmission device according to claim 1, further comprising:

a first coupling window provided between the first resonator and the second substrate, and allows the first resonator and the second resonator to be electromagnetically coupled; and a second coupling window provided between the second resonator and the first substrate, and allows the first resonator and the second resonator to be electromagnetically coupled.

6. The signal transmission device according to claim 1, wherein the second resonance section includes a third resonator and a fourth resonator which are electromagnetically coupled to each other, the third resonator being provided in a second region of the first substrate and having an open end, and the fourth resonator being provided in a region of the second substrate corresponding to the second region and having an open end, and the signal transmission device further comprises a third shielding electrode and a fourth shielding electrode, the third shielding electrode being provided between the third resonator and the second substrate and partially covering the third resonator to allow at least the open end of the third resonator to be covered therewith, and the fourth shielding electrode being provided between the fourth resonator and the first substrate and partially covering the fourth resonator to allow at least the open end of the fourth resonator to be covered therewith.

7. The signal transmission device according to claim 6, further comprising:

a first signal-lead electrode provided in the first substrate, the first signal-lead electrode being physically and directly connected to the first resonator, or being electromagnetically coupled to the first resonance section while providing a spacing between the first signal-lead electrode and the first resonance section; and a second signal-lead electrode provided in the second substrate, the second signal-lead electrode being physically and directly connected to the fourth resonator, or being electromagnetically coupled to the second resonance section while providing a spacing between the second signal-lead electrode and the second resonance section, wherein the signal transmission is performed between the first substrate and the second substrate.

8. The signal transmission device according to claim 6, further comprising:

a first signal-lead electrode provided in the second substrate, the first signal-lead electrode being physically and directly connected to the second resonator, or being electromagnetically coupled to the first resonance section while providing a spacing between the first signal-lead electrode and the first resonance section; and a second signal-lead electrode provided in the second substrate, the second signal-lead electrode being physically and directly connected to the fourth resonator, or being electromagnetically coupled to the second resonance section while providing a spacing between the second signal-lead electrode and the second resonance section, wherein the signal transmission is performed within the second substrate.

9. The signal transmission device according to claim 6, wherein the first resonance section works as a single coupled-resonator which resonates, as a whole, at a predetermined resonance frequency when the first and second resonators are electromagnetically coupled to each other in a hybrid resonance mode, and each of the first and second resonators resonates at a resonance frequency different from the predetermined resonance frequency when the first and the second substrates are separated away from each other to fail to be electromagnetically coupled to each other, and the second resonance section works as another single coupled-resonator which resonates, as a whole, at the predetermined resonance frequency when the third and fourth resonators are electromagnetically coupled to each other in a hybrid resonance mode, and each of the third and fourth resonators resonates at a resonance frequency different from the predetermined resonance frequency when the first and the second substrates are separated away from each other to fail to be electromagnetically coupled to each other.

10. A filter, comprising:

a first substrate and a second substrate which are disposed to oppose each other with a spacing in between;

a first resonance section including a first resonator and a second resonator which are electromagnetically coupled to each other, the first resonator being provided in a first region of the first substrate and having an open end, and the second resonator being provided in a region of the second substrate corresponding to the first region and having an open end;

a second resonance section disposed side-by-side relative to the first resonance section, and electromagnetically coupled to the first resonance section to perform a signal transmission between the first and second resonance sections; and a first shielding electrode and a second shielding electrode, the first shielding electrode being disposed between the first resonator and the second substrate and partially covering the first resonator to allow at least the open end of the first resonator to be covered therewith, and the second shielding electrode being disposed between the second resonator and the first substrate and partially covering the second resonator to allow at least the open end of the second resonator to be covered therewith.

11. An inter-substrate communication device, comprising:

a first substrate and a second substrate which are disposed to oppose each other with a spacing in between;

a first resonance section including a first resonator and a second resonator which are electromagnetically coupled to each other, the first resonator being provided in a first region of the first substrate and having an open end, and the second resonator being provided in a region of the second substrate corresponding to the first region and having an open end;

a second resonance section disposed side-by-side relative to the first resonance section, and electromagnetically coupled to the first resonance section to perform a signal transmission between the first and second resonance sections, the second resonance section including a third resonator and a fourth resonator which are electromagnetically coupled to each other, the third resonator being provided in a second region of the first substrate and having an open end, and the fourth resonator being provided in a region of the second substrate corresponding to the second region and having an open end;

a first shielding electrode and a second shielding electrode, the first shielding electrode being disposed between the first resonator and the second substrate and partially covering the first resonator to allow at least the open end of the first resonator to be covered therewith, and the second shielding electrode being disposed between the second resonator and the first substrate and partially covering the second resonator to allow at least the open end of the second resonator to be covered therewith;

a third shielding electrode and a fourth shielding electrode, the third shielding electrode being provided between the third resonator and the second substrate and partially covering the third resonator to allow at least the open end of the third resonator to be covered therewith, and the fourth shielding electrode being provided between the fourth resonator and the first substrate and partially covering the fourth resonator to allow at least the open end of the fourth resonator to be covered therewith;

a first signal-lead electrode provided in the first substrate, the first signal-lead electrode being physically and directly connected to the first resonator, or being electromagnetically coupled to the first resonance section while providing a spacing between the first signal-lead electrode and the first resonance section; and a second signal-lead electrode provided in the second substrate, the second signal-lead electrode being physically and directly connected to the fourth resonator, or being electromagnetically coupled to the second resonance section while providing a spacing between the second signal-lead electrode and the second resonance section, wherein the signal transmission is performed between the first substrate and the second substrate.

* * * * *